US007273662B2

(12) United States Patent
Gleeson et al.

(10) Patent No.: US 7,273,662 B2
(45) Date of Patent: Sep. 25, 2007

(54) HIGH-TEMPERATURE COATINGS WITH PT METAL MODIFIED γ-NI+γ'-$NI_3$AL ALLOY COMPOSITIONS

(75) Inventors: Brian Gleeson, Ames, IA (US); Daniel Sordelet, Ames, IA (US); Wen Wang, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 203 days.

(21) Appl. No.: 10/439,649

(22) Filed: May 16, 2003

(65) Prior Publication Data

US 2004/0229075 A1 Nov. 18, 2004

(51) Int. Cl.
*B32B 15/04* (2006.01)
*F03B 3/12* (2006.01)

(52) U.S. Cl. ..... 428/680; 428/469; 428/629; 428/670; 428/926; 428/938; 420/443; 420/444; 420/445; 420/455; 420/456; 420/460; 420/580; 148/426; 148/427; 148/428; 148/429; 148/442

(58) Field of Classification Search ..... 428/680, 428/670, 622, 623, 629, 632, 633, 469, 926, 428/938; 148/426, 427, 428, 429, 430, 442; 420/443, 444, 445, 455, 456, 460, 461, 462, 420/463, 465, 466, 467, 468, 580
See application file for complete search history.

(56) References Cited

U.S. PATENT DOCUMENTS 4,123,594 A * 10/1978 Chang ..... 428/651
4,123,595 A * 10/1978 Chang ..... 428/667
4,392,894 A * 7/1983 Pearson et al. ..... 148/556
5,514,482 A 5/1996 Strangman
5,763,107 A 6/1998 Rickerby et al.
5,981,091 A * 11/1999 Rickerby et al. ..... 428/670
6,306,524 B1 10/2001 Spitsberg et al.
6,436,473 B2 8/2002 Darolia et al.
6,485,844 B1 * 11/2002 Strangman et al. ..... 428/632
6,554,920 B1 4/2003 Jackson et al.
2006/0093752 A1 5/2006 Darolia et al.

FOREIGN PATENT DOCUMENTS

EP 1 321 541 A2 6/2003
EP 1327702 A1 7/2003
WO WO 01/75192 A2 10/2001
WO WO 07/008227 1/2007

OTHER PUBLICATIONS

Leyens et al., "R&D Status and Needs for Improved EB-PVD Thermal Barrier Coating Performance," *Mat. Res. Soc. Symp. Proc.*, 2001, vol. 645E, pp. M10.1.1-M10.1.12, no month given.
Peters et al., "EB-PVD Thermal Barrier Coatings for Aeroengines and Gas Turbines," *Advanced Engineering Materials*, 2001, 3(4):193-204, no month given.

(Continued)

*Primary Examiner*—John J. Zimmerman
*Assistant Examiner*—Aaron Austin
(74) *Attorney, Agent, or Firm*—Shumaker & Sieffert, P.A.

(57) ABSTRACT

An alloy including a Pt-group metal, Ni and Al in relative concentration to provide a γ-Ni+γ'-$Ni_3$Al phase constitution, and a coating including the alloy.

48 Claims, 18 Drawing Sheets

OTHER PUBLICATIONS

V.K. Tolpygo and D.R. Clarke, "Microstructural study of the theta-alpha transformation in alumina scales formed on nickel-aluminides," *Materials at High Temperatures*, vol. 17, No. 1, pp. 59-70 (2000), no month given.

J.A. Haynes, B.A. Pint, W.D. Porter and I.G. Wright, "Comparison of thermal expansion and oxidation behavior of various high-temperature coating materials and superalloys," *Materials at High Temperatures*, vol. 21, No. 2, pp. 87-94 (2004), no month given.

PCT International Search Report and PCT Written Opinion from corresponding PCT Application No. PCT/US2004/014740, mailed Mar. 2, 2005 (9 pages).

International Preliminary Report on Patentability from corresponding patent application No. PCT/US2004/01470, mailed Dec. 1, 2005, (7 pages).

Murakami et al., "Distribution of Platinum Group Metal in Ni-Base Single-Crystal Superalloys", Superalloys Proceedings International Symposium Superalloys, Sep. 17, 2000, pp. 747-756; XP009057026.

Reid et al., "Microstructural Transformations in Platinum Aluminide Coated CMSX-4 Superalloy", Materials Science Forum vols. 461-464, pp. 343-350, (2004), XP009077214.

Goebel et al., "Interdiffusion between the platinum-modified aluminide coating RT 22 and nickel-based single-crystal superalloys at 1000 and 1200° C.", Materials at High Temperatures, vol. 12, No. 4, pp. 301-309, (1994), XP009077277.

Chen et al., "Degradation of the platinum aluminide coating on CMSX4 at 1100° C.", Surface & Coatings Technology, pp. 69-77, (1997), XP002416853.

* cited by examiner

Weight change of Ni-Al-Pt alloys of different phase constitutions after "isothermal" exposure at 1150°C in still air. Also included for comparison is binary β-NiAl of stoichiometric composition.

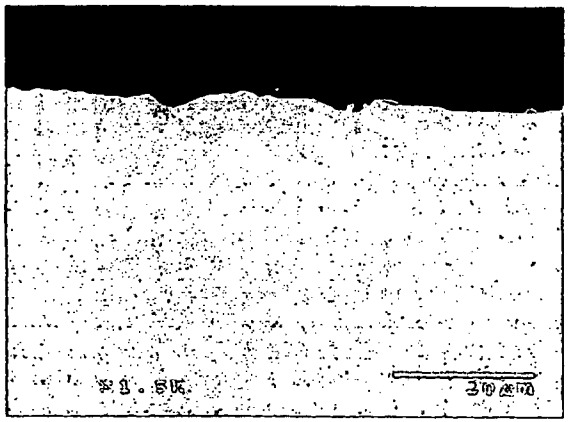
FIG. 7A β-NiAl (50Al50Ni)
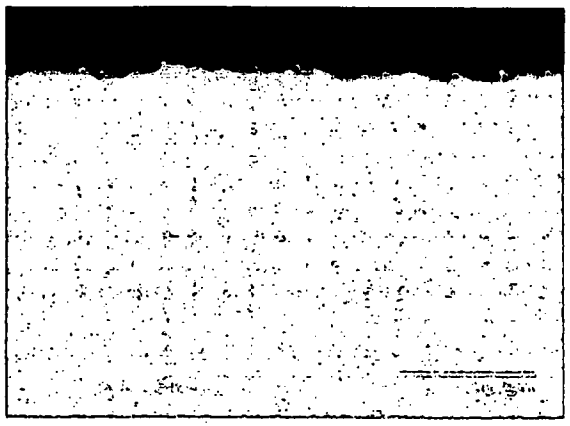
FIG. 7B β-NiAl(Pt) (50Al35Ni15Pt)
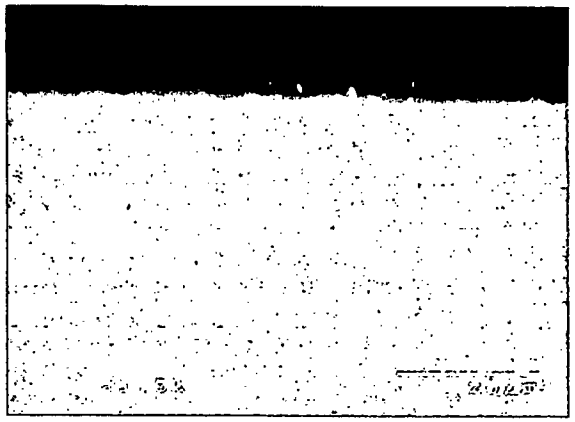
FIG. 7C β-NiAl + $PtAl_2$ (48Al26Ni26Pt)
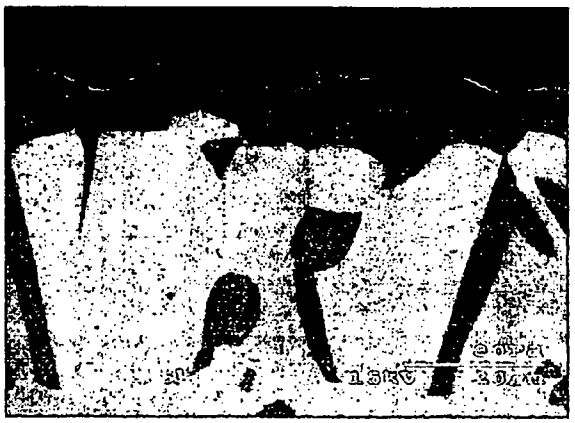
FIG. 7D γ-Ni + γ'-$Ni_3Al$ (22Al48Ni30Pt)
Cross-sectional images of selected alloys shown in Fig. 6 after 100 h oxidation at 1150°C in air. The compositions are nominal and in atom percent.

Ni-22Al-30Pt

Ni-22Al-25Pt

Ni-22Al-30Pt-0.5Hf

Cross-sectional images of selected γ' + γ alloys after 1000 h isothermal oxidation at 1150°C in air. All images are the same magnification (x500). The compositions are nominal and in atom percent.

Cross-sectional Images of $\gamma' + \gamma$ Alloys After Isothermal Oxidation at 1150°C in Air

#B3: Ni-22Al (60h)

#42: Ni-22Al-10Pt (500h)

#27: Ni-22Al-20Pt (500h)

#7: Ni-22Al-30Pt (500h)

Comparison of the cyclic oxidation kinetics of Pt-modified β-NiAl, Pt-modified γ'-$Ni_3Al$+γ-Ni, and Pt modified γ'-$Ni_3Al$+γ-N with Hf at 1150°C in air.

Surface and Cross-Sectional Images After 1000 Cycles Oxidation at 1150° C in Air Ni-22Al-30Pt Ni-22Al-30Pt-1wt%Hf Surface and Cross-Sectional Images After 1000 h Isothermal Oxidation at 1150°C in Air
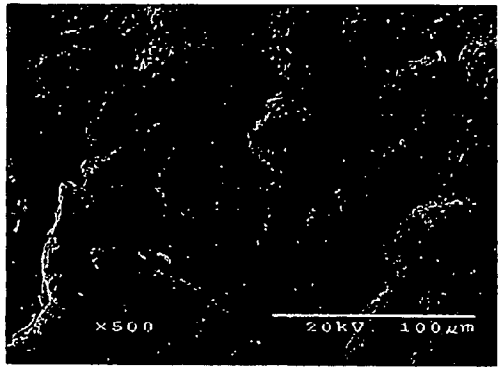
FIG. 17A
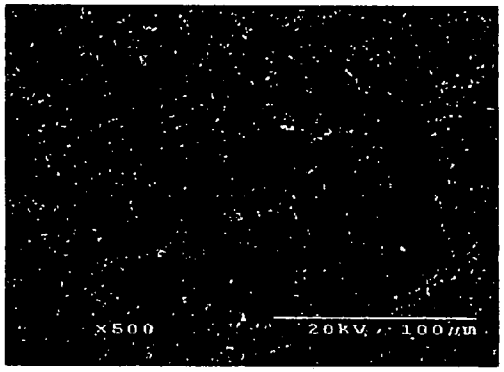
FIG. 17C
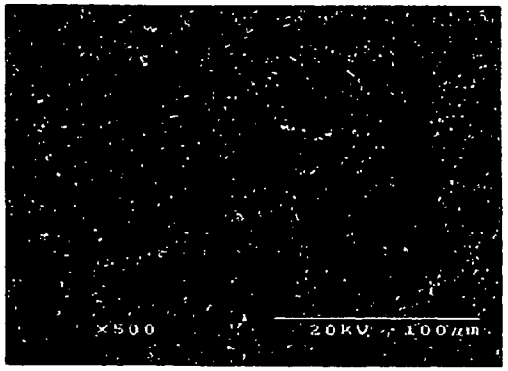
FIG. 17E
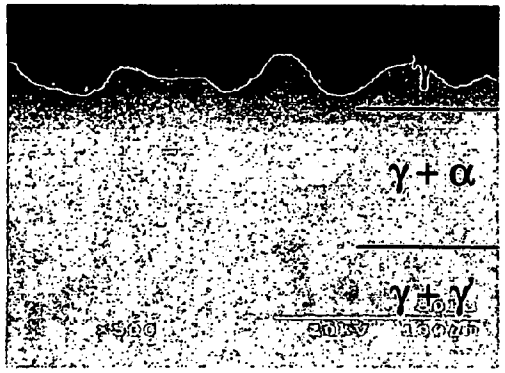
FIG. 17B Alloy 7 (Ni-22Al-30Pt)
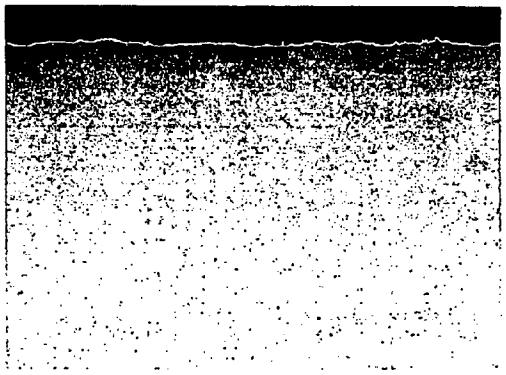
FIG. 17D Alloy 32 (#7 + 1wt%Hf))
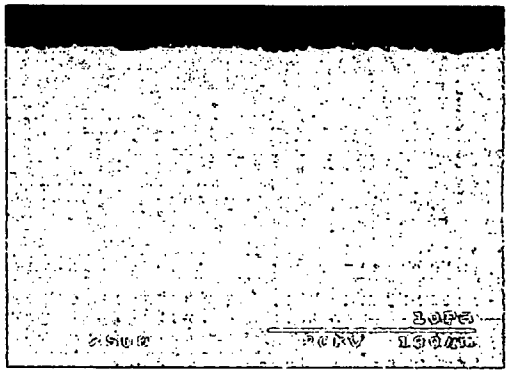
FIG. 17F Alloy 36 (#7 + 2wt%Hf))

Microstructure and composition profiles through a γ'+γ (Ni-22Al-30Pt) / γ'+γ (Ni-22Al) couple after 50 h interdiffusion at 1150°C, Microstructure and composition profiles through a γ'+γ (Ni-22Al-30Pt)/CMSX-4 couple after 50 h interdiffusion at 1150°C. The aluminum profile shows that there was Al-enrichment in the γ'+γ side of the couple, i.e., there was uphill diffusion of aluminum.

HIGH-TEMPERATURE COATINGS WITH PT METAL MODIFIED γ-NI+γ'-$NI_3$AL ALLOY COMPOSITIONS

STATEMENT REGARDING FEDERALLY SPONSORED RESEARCH AND DEVELOPMENT

The U.S. Government has a paid-up license in this invention and the right in limited circumstances to require the patent owner to license others on reasonable terms as provided by the terms of Contract Nos. N00014-00-1-0484 and N00014-02-1-0733, each awarded by the Office of Naval Research.

TECHNICAL FIELD

This invention relates to alloy compositions for high-temperature, oxidation resistant coatings. Coatings based on these alloy compositions may be used, for example, as part of a thermal barrier system for components in high-temperature systems.

BACKGROUND

The components of high-temperature mechanical systems, such as, for example, gas-turbine engines, must operate in severe environments. For example, the high-pressure turbine blades and vanes exposed to hot gases in commercial aeronautical engines typically experience metal surface temperatures of about 1000° C., with short-term peaks as high as 1100° C. A portion of a typical metallic article 10 used in a high-temperature mechanical system is shown in FIG. 1. The blade 10 includes a Ni or Co-based superalloy substrate 12 coated with a thermal barrier coating (TBC) 14. The thermal barrier coating 14 includes a thermally insulative ceramic topcoat 20 and an underlying metallic bond coat 16. The topcoat 20, usually applied either by air plasma spraying or electron beam physical vapor deposition, is most often a layer of yttria-stabilized zirconia (YSZ) with a thickness of about 300–600 μm. The properties of YSZ include low thermal conductivity, high oxygen permeability, and a relatively high coefficient of thermal expansion. The YSZ topcoat 20 is also made "strain tolerant" by depositing a structure that contains numerous pores and/or pathways. The consequently high oxygen permeability of the YSZ topcoat 20 imposes the constraint that the metallic bond coat 16 must be resistant to oxidation attack. The bond coat 16 is therefore sufficiently rich in Al to form a layer 18 of a protective thermally grown oxide (TGO) scale of α-$Al_2O_3$. In addition to imparting oxidation resistance, the TGO bonds the ceramic topcoat 20 to the substrate 12 and bond coat 16. Notwithstanding the thermal protection provided by the thermal barrier coating 14, the spallation and cracking of the thickening TGO scale layer 18 is the ultimate failure mechanism of commercial TBCs. Thus, improving the adhesion and integrity of the interfacial TGO scale 18 is critical to the development of more reliable TBCs. Related to this is the need to significantly reduce the progressive roughening or "rumpling" of the bond coat surface during thermal exposure, which is a formidable limitation of conventional bond coat systems.

The adhesion and mechanical integrity of the TGO scale layer 18 is very dependent on the composition and structure of the bond coat 16. Ideally, when exposed to high temperatures, the bond coat 16 should oxidize to form a slow-growing, non-porous TGO scale that adheres well to the superalloy substrate 12. Conventional bond coats 16 are typically either an MCrAlY overlay (where M=Ni, Co, NiCo, or Fe) or a platinum-modified diffusion aluminide (β-NiAl-Pt). The Al content in these coatings is sufficiently high that the $Al_2O_3$ scale layer 18 can "re-heal " following repeated spalling during service of the turbine component.

However, the adhesion, and therefore the reliability, of the TBC system is measured with respect to the first spallation event of the TGO scale layer 18. As a result, once the first spallation event occurs in the scale layer 18, the ceramic topcoat 20 can begin to delaminate and fail, so that re-healing of the scale layer 18 is not a critically important performance requirement for the adhesion of the ceramic topcoat 20. Thus, conventional bond coats, which were designed primarily for re-healing the $Al_2O_3$ TGO scale layer, do not necessarily possess the optimum compositions and/or phase constitutions to provide enhanced scale layer adhesion and improved TBC reliability.

Another approach to improving the adhesion of the TGO scale layer on a second metallic article 28 is shown in FIG. 2A. A superalloy substrate 30 is coated on an outer surface with a layer 32 of Pt and then heat-treated. Referring to FIG. 2B, following this heat treatment Al diffuses from the superalloy substrate 30 into the Pt layer 32 to form a surface-modified outer region 34 on the superalloy substrate (FIG. 2B). An $Al_2O_3$ TGO scale layer 38 and a ceramic layer topcoat 40 may then be formed on the surface modified region 34 using conventional techniques. However, since transition metals from the superalloy substrate 30 are also present in the surface modified region 34, it is difficult to precisely control the composition and phase constitution of the surface region 34 to provide optimum properties to improve adhesion of the TGO scale layer 38.

Future improvements in gas-turbine performance will require even higher operating efficiencies, longer operating lifetimes, reduced emissions and, therefore, higher turbine operating temperatures. Improved TBCs are needed to protect turbine operating components at increased temperatures (e.g. 1150° C.), and new bond coat compositions must be developed to reduce spallation and increase adhesion of the TGO layer, which will result in an enhanced reliability for the ceramic topcoat layer.

SUMMARY

As noted above, conventional γ-NiAl—Pt bond coats have a relatively high Al content to promote healing of the $Al_2O_3$ TGO scale layer following spallation. As a result of this Al enriched composition and the predominance of the β-NiAl phase constitution of the base alloy in the coating microstructure, these bond coats are not compatible with the phase constitution of the Ni-based superalloy substrates, which have a γ-Ni+γ'-NiAl microstructure. When applied to a superalloy substrate having a γ-Ni+γ'-NiAl phase structure, since the β-NiAl—Pt alloys have a significantly higher Al concentration, Al diffuses from the bond coat layer to the substrate at the interface between the adjacent layers. This Al interdiffusion depletes Al in the bond coat layer, which reduces the ability of the coating to sustain $Al_2O_3$ scale growth. Additional diffusion also introduces unwanted elements that can promote oxide scale spallation. A further consequence of coating/substrate interdiffusion, particularly for the next generation of superalloys containing up to 6 wt % rhenium, is the formation of brittle and hence deleterious topologically-closed-pack (TCP) phases, such as σ, in the region of the original coating/substrate interface. This TCP phase formation deterimentally affects the mechanical properties and can greatly shorten the useful service life of the coated component.

In one aspect, the invention is an alloy including a Pt-group metal, Ni and Al in relative concentration to provide a γ+γ' phase constitution. In this application γ' refers to the solid-solution Ni phase and γ' refers to the solid-solution $Ni_3Al$ phase.

In another aspect, the invention is an alloy including a Pt-group metal, Ni and Al, wherein the concentration of Al is limited with respect to the concentrations of Ni and the Pt-group metal such that the alloy includes substantially no β-NiAl phase.

In yet another aspect, the invention is a ternary Ni—Al—Pt alloy including less than about 23 at % Al, about 10 at % to about 30 at % of a Pt-group metal, and the remainder Ni.

In yet another aspect, the invention is an alloy including Ni, Al and Pt as defined in the region A in FIG. 3.

In yet another aspect, the invention is a coating composition including a Pt-group metal, Ni and Al, wherein he composition has a γ-Ni+γ'-$Ni_3Al$ phase constitution. The composition may further include a reactive element such as Hf in sufficient concentration to provide one of a γ+γ' or γ' phase constitution.

In yet another aspect, the invention is a thermal barrier coated article including (a) a superalloy substrate; and (b) a bond coat on the substrate, wherein the bond coat includes a Pt-group metal, Ni and Al, and wherein the bond coat has a γ-Ni+γ'-$Ni_3Al$ phase constitution. The bond coat may further include a reactive element such as Hf in sufficient concentration to provide one of a γ+γ' or γ' phase constitution.

In yet another aspect, the invention is a method for making a heat-resistant substrate including applying on the substrate a coating including Ni and Al in a γ-Ni+γ'-$Ni_3Al$ phase constitution. The coating may further include a reactive element such as Hf in sufficient concentration to provide one of a γ+γ' or γ' phase constitution.

In yet another aspect, the invention is a thermal barrier coated article including a superalloy substrate; a bond coat on the substrate, wherein the bond coat includes a ternary alloy of Pt—Ni—Al, and wherein the alloy has a γ-Ni+γ'-$Ni_3Al$ phase constitution; an adherent layer of oxide on the bond coat; and a ceramic coating on the adherent layer of oxide.

In yet another aspect, the invention is a method for reducing oxidation in γ-Ni+γ'-$Ni_3Al$ alloys, including adding a Pt-group metal and an optional a reactive element to the alloys.

In yet another aspect, the invention is a homogeneous coating including an alloy with a γ-Ni+γ'-$Ni_3Al$ phase constitution.

The Pt-group metal modified alloys of the present invention have a gamma-Ni phase and a gamma prime-$Ni_3Al$ (referred to herein as γ-Ni+7'-$Ni_3Al$ or γ+γ') phase constitution that is both chemically and mechanically compatible with the γ+γ' microstructure of a typical Ni-based superalloy substrate. The Pt-group metal modified γ+γ' alloys are particularly useful in bond coat layers applied on a superalloy substrate used in a high-temperature resistant mechanical components.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 7A–D is a series of cross-sectional images of selected alloys shown in FIG. 6 after 100 h oxidation at 1150° C. in air. The compositions are nominal and in atom percent.

FIG. 17A,C,E and FIG. 17B,D,F are surface and cross-sectional images, respectively, illustrating the effect of Hf modification on selected Pt-modified β-NiAI, γNi+γ'-$Ni_3Al$ alloys of Example 1 and FIG. 16.

Like reference symbols in the various drawings indicate like elements.

DETAILED DESCRIPTION

In one aspect, the invention is a platinum (Pt) group metal modified γ-Ni+γ'-$Ni_3Al$ alloy, which in this application refers to an alloy including a Pt-group metal, Ni and Al in relative concentration such that a γ-Ni+γ'-$Ni_3Al$ phase constitution results. In this alloy the concentration of Al is limited with respect to the concentration of Ni and the Pt-group metal such that substantially no β-NiAl phase structure, preferably no β-NiAl phase structure, is present in the alloy, and the γ-Ni+γ'-$Ni_3Al$ phase structure predominates.

The Pt-group metal may be selected from, for example, Pt, Pd, Ir, Rh and Ru, or combinations thereof. Pt-group metals including Pt are preferred, and Pt is particularly preferred.

In the alloy Al is preferably present at less than about 23 at %, preferably about 10 at % to about 22 at % (3 wt % to 9 wt %), the Pt-group metal is present at about 10 at % to about 30 at % (12 wt % to 63 wt %), preferably about 15 at % to about 30 at %, with the remainder Ni. The at % values specified for all elements in this application are nominal, and may vary by as much as ±1–2 at %.

Additional reactive elements such as Hf, Y, La, Ce and Zr, or combinations thereof, may optionally be added to or present in the ternary Pt-group metal modified γ-Ni+γ'-$Ni_3Al$ alloy to modify and/or improve its properties. The addition of such reactive elements tends to stabilize the γ' phase. Therefore, if sufficient reactive metal is added to the composition, the resulting phase constitution may be predominately γ' or solely γ'. The Pt-group metal modified γ-Ni+γ'-$Ni_3Al$ alloy exhibits excellent solubility for reactive elements compared to conventional β—NiAl—Pt alloys, and typically the reactive elements may be added to the γ+γ' alloy at a concentration of up to about 2 at % (4 wt %), preferably 0.3 at % to 2 at % (0.5 wt % to 4 wt %), more preferably 0.5 at % to 1 at % (1 wt % to 2 wt %). A preferred reactive element includes Hf, and Hf is particularly preferred.

In addition, other typical superalloy substrate constituents such as, for example, Cr, Co, Mo, Ta, and Re, and combinations thereof, may optionally be added to or present in the Pt-group metal modified γ-Ni+γ'-$Ni_3Al$ alloy in any concentration to the extent that a γ+γ' phase constitution predominates.

Figure 1:
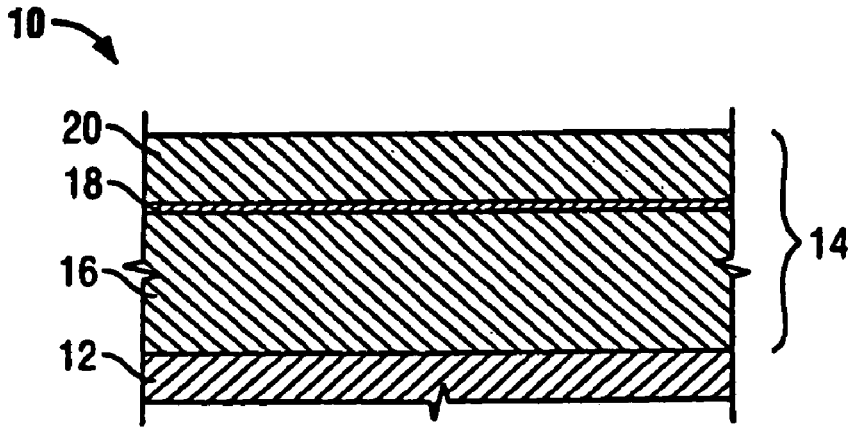
FIG. 1 is a cross-sectional diagram of a metallic article with a thermal barrier coating.
Figure 2A:
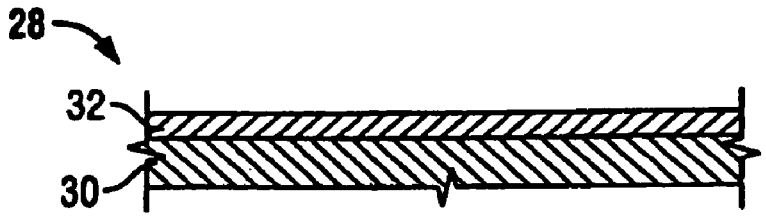
FIG. 2A is a cross-sectional diagram of a metallic article coated with a Pt layer, prior to heat treatment.
Figure 2B:
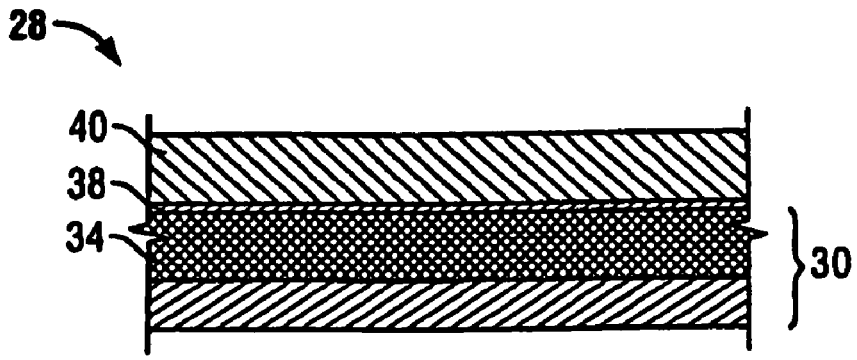
FIG. 2B is a cross-sectional diagram of the metallic article of FIG. 2A following heat treatment of the superalloy substrate and application of a conventional thermal barrier coating.
Figure 3:
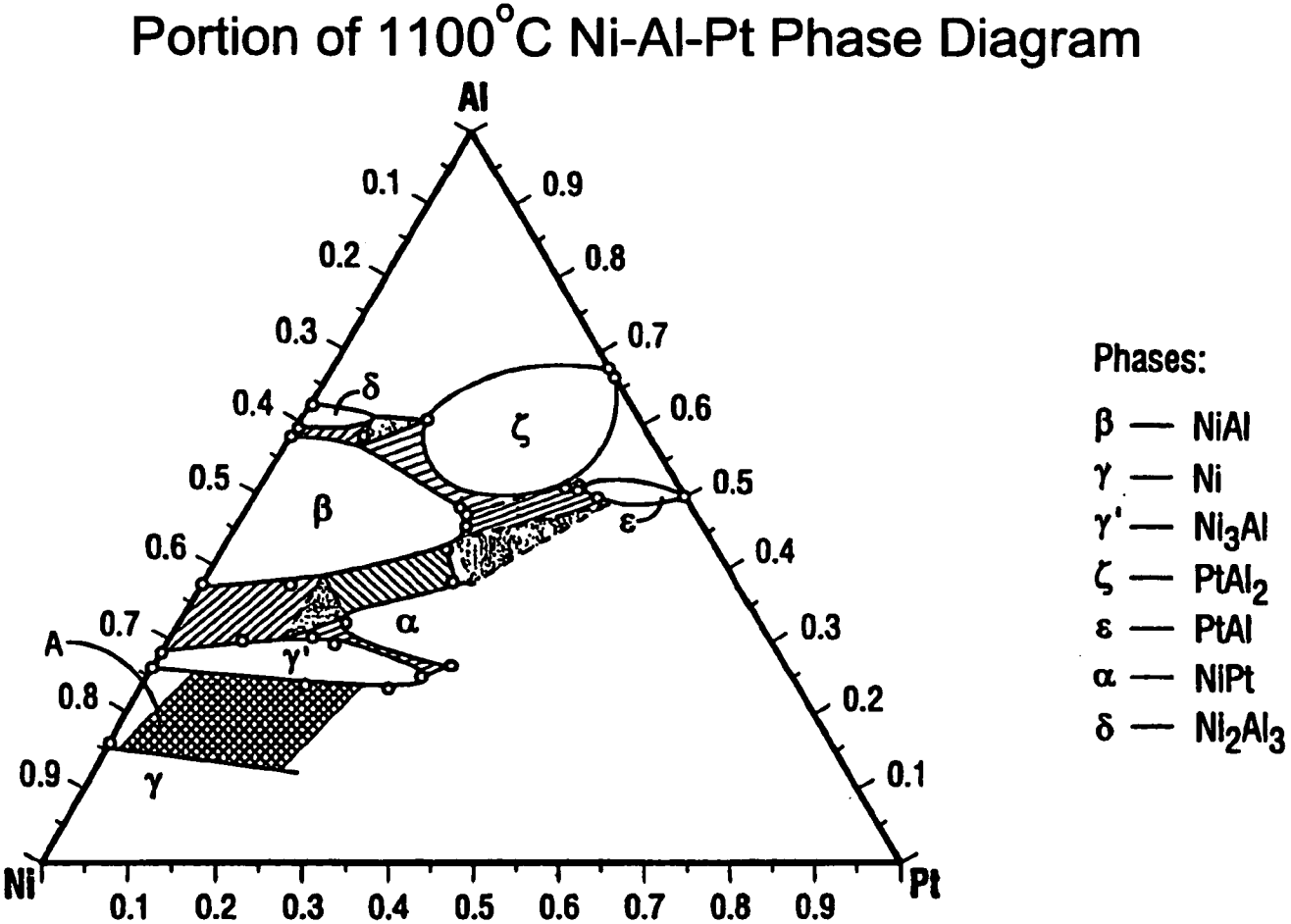
FIG. 3 is a portion of a 1100° C. Ni—Al—Pt phase diagram showing an embodiment of the Pt metal modified γ-Ni+γ'-$Ni_3Al$ alloy compositions of the invention.

Referring to FIG. 3, a portion of a phase diagram of an embodiment of the invention is shown in which the Pt-group metal is Pt. In this embodiment the Ni—Al—Pt phase diagram includes phases β-NiAl (region β), γ-Ni (region γ) and γ'-$Ni_3Al$ (region γ'). In this embodiment, if the Al concentration is selected with respect to the concentration of Ni and Pt such that the ternary alloy falls within the shaded region A falling between the γ-Ni and the γ'-$Ni_3Al$ phase fields, then the components are present in a γ+γ' structure.

In the embodiment depicted in the region A of FIG. 3, Al is preferably present at less than about 23 at %, preferably about 10 at % to about 22 at % (3 wt % to 9 wt %) and Pt is present at about 10 at % to about 30 at % (12 wt % to 63 wt %), preferably about 15 at % to about 30 at %, with the remainder Ni. An optional reactive element such as Hf, if present, may be added at a concentration of about 0.3 at % to about 2 at % (0.5 wt % to 4 wt %).

The alloys may be prepared by conventional techniques such as, for example, argon-arc melting pieces of high-purity Ni, Al, Pt-group metals and optional reactive and/or superalloy metals and combinations thereof.

Figure 4:
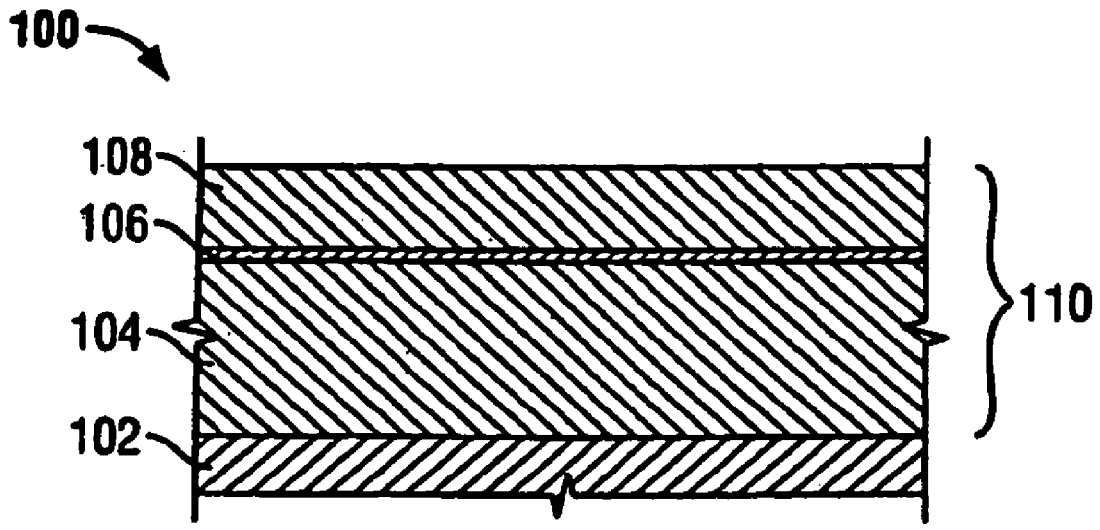
FIG. 4 is a cross-sectional diagram of a metallic article with a thermal barrier coating.

The Pt-group metal modified γ-Ni+γ'-$Ni_3Al$ alloy may be applied on a substrate to impart high-temperature degradation resistance to the substrate. Referring to FIG. 4, a typical substrate will typically be a Ni or Co-based superalloy substrate 102. Any conventional Ni or Co-based superalloy may be used as the substrate 102, including, for example, those available from Martin-Marietta Corp., Bethesda, Md., under the trade designation MAR-M 002; those available from Cannon-Muskegon Corp., Muskegon, Mich., under the trade designation CMSX-4, CMSX-10, and the like.

The Pt-group metal modified γ-Ni+γ'-$Ni_3Al$ alloy may be applied to the substrate 102 using any known process, including for example, plasma spraying, chemical vapor deposition (CVD), physical vapor deposition (PVD) and sputtering to create a coating 104 and form a temperature-resistant article 100. Typically this deposition step is performed in an evacuated chamber.

The thickness of the coating 104 may vary widely depending on the intended application, but typically will be about 5 μm to about 100 μm, preferably about 5 μm to about 50 μm, and most preferably about 10 μm to about 50 μm. The composition of the coating 104 may be precisely controlled, and the coating has a substantially homogenous γ+γ' constitution, which in this application means that the γ+γ' structure predominates though the entire thickness of the coating. In addition, the coating 104 has a substantially constant Pt-group metal concentration throughout its entire thickness.

If the coating 104 is a bond coat layer, a layer of ceramic typically consisting of partially stabilized zirconia may then be applied using conventional PVD processes on the bond coat layer 104 to form a ceramic topcoat 108. Suitable ceramic topcoats are available from, for example, Chromalloy Gas Turbine Corp., Delaware, USA. The deposition of the ceramic topcoat layer 108 conventionally takes place in an atmosphere including oxygen and inert gases such as argon. The presence of oxygen during the ceramic deposition process makes it inevitable that a thin oxide scale layer 106 is formed on the surface of the bond coat 104. The thermally grown oxide (TGO) layer 106 includes alumina and is typically an adherent layer of α-$Al_2O_3$. The bond coat layer 104, the TGO layer 106 and the ceramic topcoat layer 108 form a thermal barrier coating 110 on the superalloy substrate 102.

The Pt-group metal modified γ-Ni+γ'-$Ni_3Al$ alloys utilized in the bond coat layer 104 are both chemically and mechanically compatible with the γ+γ' phase constitution of the Ni or Co-based superalloy 102. Protective bond coats formulated from these alloys will have coefficients of thermal expansion (CTE) that are more compatible with the CTEs of Ni-based superalloys than the CTEs of β-NiAl—Pt based alloy bond coats. The former provides enhanced thermal barrier coating stability during the repeated and severe thermal cycles experienced by mechanical components in high-temperature mechanical systems.

When thermally oxidized, the Pt-group metal modified γ-Ni+γ'-$Ni_3Al$ alloy bond coats grow an α-$Al_2O_3$ scale layer at a rate comparable to or slower than the thermally grown scale layers produced by conventional β-NiAl—Pt bond coat systems, and this provides excellent oxidation resistance for γ-Ni+γ'-$Ni_3Al$ alloy compositions. The Pt-metal modified γ+γ' alloys also exhibit much higher solubility for reactive elements such as, for example, Hf, than conventional β-NiAl-Pt alloys, which makes it possible to further tailor the alloy formulation for a particular application. For example, when the Pt-metal modified γ+γ' alloys are formulated with other reactive elements such as, for example, Hf, and applied on a superalloy substrate as a bond coat, the growth of the TGO scale layer is even slower. After prolonged thermal exposure, the TGO scale layer further appears more planar and has enhanced adhesion on the bond coat layer compared to scale layers formed from conventional β-NiAl—Pt bond coat materials.

In addition, the thermodynamic activity of Al in the Pt-group metal modified γ-Ni+γ'-$Ni_3Al$ alloys can, with sufficient Pt content, decrease to a level below that of the Al in Ni-based superalloy substrates. When such a bond coating including the Pt-group metal modified γ-Ni+γ'-$Ni_3Al$ alloys is applied on a superalloy substrate, this variation in thermodynamic activity causes Al to diffuse up its concentration gradient from the superalloy substrate into the coating. Such "uphill diffusion" reduces and/or substantially eliminates Al depletion from the coating. This reduces spallation in the scale layer, increases the stability of the scale layer, and enhances the service life of the ceramic topcoat in the thermal barrier system.

Thermal barrier coatings with bond coats including the Pt-group metal modified γ-Ni+γ'-$Ni_3Al$ alloys may be applied to any metallic part to provide resistance to severe thermal conditions. Suitable metallic parts include Ni and Co based superalloy components for gas turbines, particularly those used in aeronautical and marine engine applications.

EXAMPLES

Example 1

Ni-Al-Pt alloys and Ni—Al—Pt alloys modified with Hf were prepared by argon-arc melting pieces of high-purity Ni, Al, Pt, and Hf. To ensure homogenization and equilibrium, all alloys were annealed at 1100° C. or 1150° C. for 1 week in a flowing argon atmosphere and then quenched in water to retain the high-temperature structure. The alloys were cut into coupon samples and polished to a 600-grit finish for the further testing on phase equilibrium, oxidation, and interdiffusion.

The equilibrated samples were first analyzed using X-ray diffraction (XRD) for phase identification and then prepared for metallographic analyses by cold mounting them in an epoxy resin followed by polishing to a 0.5 μm finish. Microstructure observations were initially carried out on etched samples using an optical microscope. Concentration profiles were obtained from un-etched (i.e., re-polished) samples by either energy (EDS) or wavelength (WDS) dispersive spectrometry, with the former utilizing a secondary electron microscope (SEM) and the latter an electron probe micro-analyzer (EPMA). Differential thermal analysis (DTA) Was also conducted on selected samples to determine thermal stability of different phases.

The identified alloy compositions are shown in Table 1:

TABLE 1

| | | Overall Comp. | | | Phases Comp. γ' - $Ni_3Al$ | | | Phases Comp. γ - Ni | | |
|---|---|---|---|---|---|---|---|---|---|---|
| Alloy | | Ni | Al | Pt | Ni | Al | Pt | Ni | Al | Pt |
| 7 | at. % | 48 | 22 | 30 | 47.6 | 21.9 | 30.5 | 63.6 | 13.3 | 23.1 |
| | wt. % | 30.4 | 6.4 | 63.2 | 29.9 | 6.3 | 63.8 | 43.4 | 4.2 | 52.4 |
| 27 | at. % | 58 | 22 | 20 | 57.4 | 21.5 | 21.1 | 69.5 | 14.6 | 15.9 |
| | wt. % | 43.1 | 7.5 | 49.4 | 41.8 | 7.2 | 51.0 | 53.9 | 5.2 | 40.9 |
| 28 | at. % | 53 | 22 | 25 | 52.8 | 22.1 | 25.1 | 66.6 | 14.1 | 19.3 |
| | wt. % | 36.3 | 6.9 | 56.8 | 36.1 | 6.9 | 57.0 | 48.5 | 4.7 | 46.8 |
| 29 | at. % | 64 | 16 | 20 | 55.2 | 20.5 | 24.3 | 67.3 | 13.7 | 19.0 |
| | wt. % | 46.5 | 5.3 | 48.2 | 38.0 | 6.5 | 55.5 | 49.2 | 4.6 | 46.2 |
| 42 | at. % | 68 | 22 | 10 | — | — | — | — | — | — |
| | wt. % | 61.1 | 9.1 | 29.8 | — | — | — | — | — | — |

Figure 5:
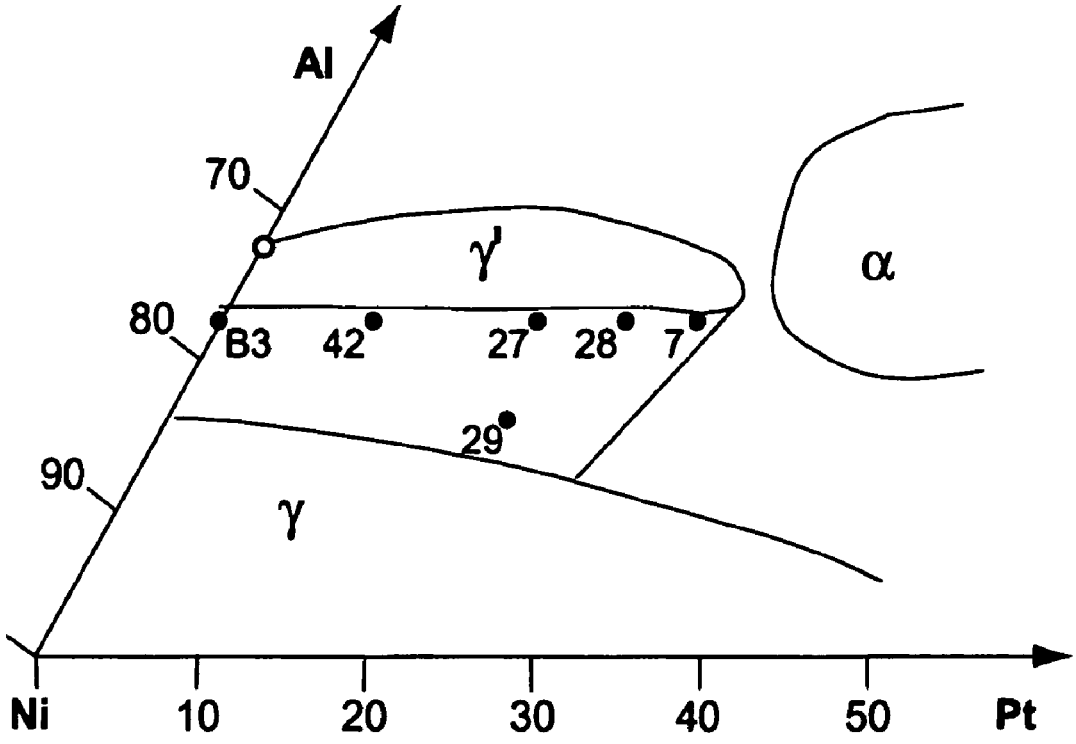
FIG. 5 is a portion of a Ni—Al—Pt phase diagram showing the alloy compositions of Example 1.

The identified alloy compositions are also depicted on a Ni-rich portion of the NiAlPt phase diagram shown in FIG. 5. From this portion of the phase diagram it is evident that alloys 7, 27, 28, 32 and 42 are composed primarily of the γ' phase, while alloys 29 and 38 are primarily of the γphase.

Example 2

Isothermal and Cyclic Oxidation

Isothermal and cyclic oxidation tests were carried out at 1100 and 1150° C. in still air using a vertical furnace. Isothermal oxidation kinetics were monitored by intermittently cooling the samples to room temperature and then measuring sample weight change using an analytical balance. No attempt was made to retain any scale that may have spalled during cooling to room temperature or handling. As a consequence, weight-loss kinetics were sometimes observed. Cyclic oxidation testing involved repeated thermal cycles of one hour at temperature (1100 or 1150° C.) followed by cooling and holding at about 120° C. for 15 minutes. Sample weight change was measured periodically during the cool-down period. Raising and lowering the vertical furnace via a timer-controlled, motorized system achieved thermal cycling. At the end of a given test, the oxidized samples were characterized using XRD, SEM and EDS.

Example 2A

Figure 6:
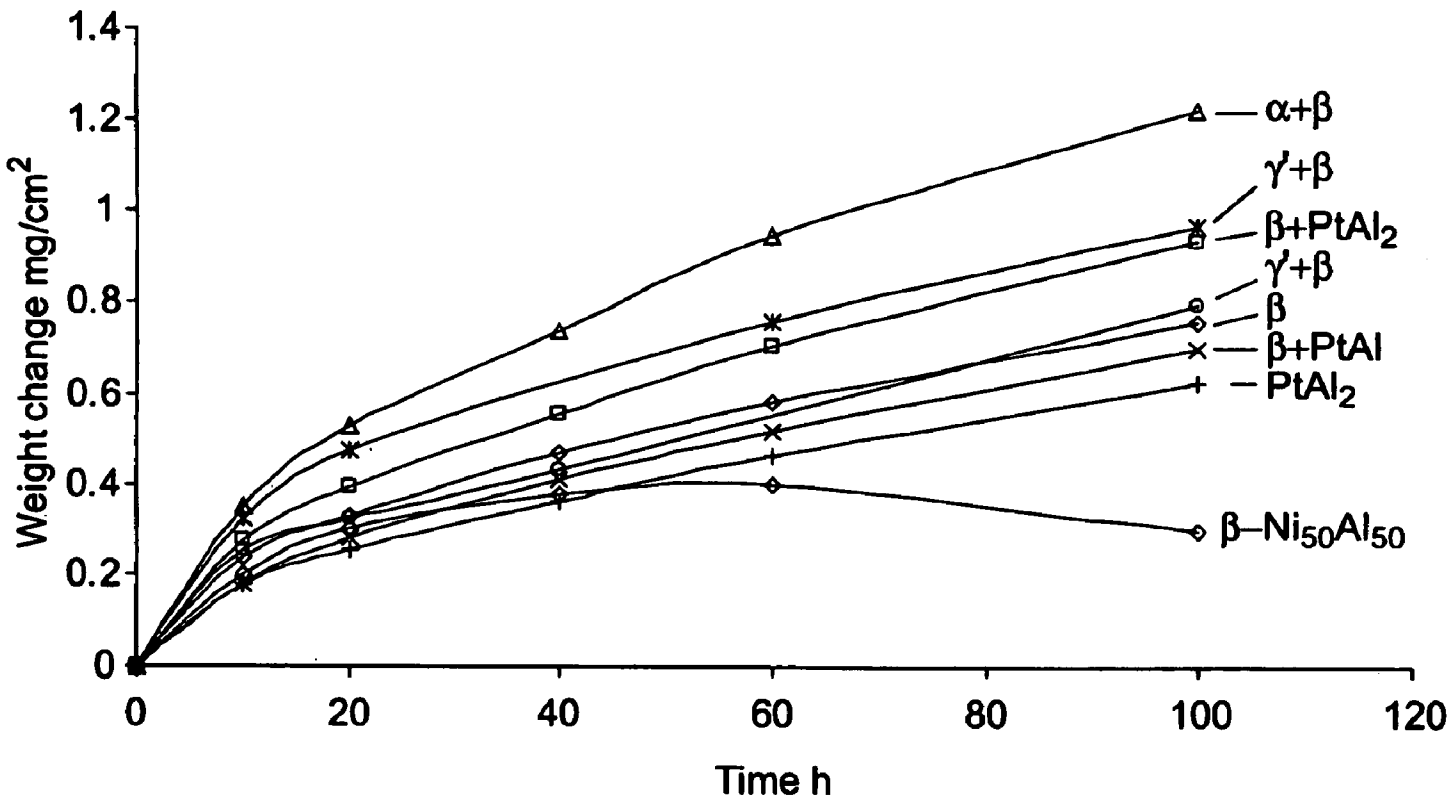
FIG. 6 is a plot showing weight change of Ni—Al—Pt alloys of different phase constitutions after "isothermal" exposure at 1150° C. in still air.

The "isothermal" oxidation behavior at 1150° C. in still air of a range of Ni—Al—Pt alloys of different phase constitutions is shown in FIG. 6. The γ+γ' alloy in this example was the same as alloy 7 in Example 1 above. All of the alloys shown formed an $Al_2O_3$-rich TGO scale layer, as confirmed by XRD. Sample weight changes were measured at room temperature after 20, 40, 60 and 100 hours of exposure. Accordingly, the oxidation test was not truly isothermal. The alloy labeled β in FIG. 6 is β-NiAl containing nominally 50 at % Al and 10 at % Pt This alloy exhibited positive weight-change kinetics over time and, hence, limited scale spallation. Comparison of the oxidation behavior of binary β-NiAl to that of Pt-modified β-NiAl leads to the conclusion that Pt addition to NiAl-based alloys reduces spallation and enhances TGO scale adhesion. The low weight-change kinetics of the ternary Pt-modified γ+γ' alloy is comparable to those of the β containing alloys, which have higher concentrations of Al. Binary γ'+γ' alloys exposed under similar conditions were found to undergo significantly higher weight-change kinetics followed by excessive scale spallation. Thus, the addition of Pt to γ+γ' alloys not only improves scale adhesion, but also promotes $Al_2O_3$ scale formation.

Cross-sectional SEM images of selected alloys from the 1150° C. isothermal oxidation test (FIG. 6) are shown in FIG. 7. Each alloy was exposed for 100 hours. The poor scale adhesion of the $Al_2O_3$ TGO scale layer on the binary β-NiAl bond coat is clearly evidenced by the gap between the scale layer and the bond coat. Scale adhesion appeared to be quite good for the Pt-modified β-containing alloy bond coats and the Pt modified γ+γ' alloy bond coats. However, in the case of the Pt modified γ+γ' alloy bond coat, the bond coat/TGO scale interface is non-planar, i.e., rumpled. Selective aluminum oxidation caused the subsurface region of this Pt modified γ+γ' alloy (alloy 7) to transform into a continuous γ layer followed by a layer of γ+α. Both layers were found to increase in thickness with increasing time of oxidation. The Pt modified γ+γ' alloy bond coat shown in FIG. 7 is alloy 7 in Example 1 above (Ni-22Al-30Pt).

Figure 8A:
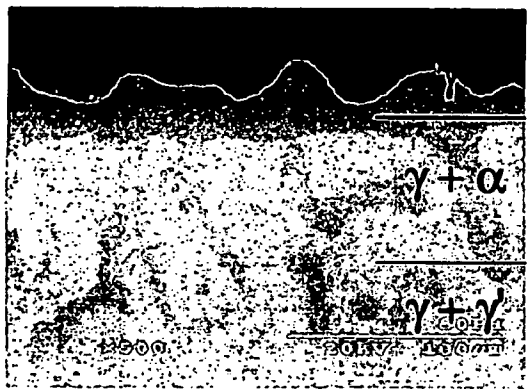
FIG. 8A–C is a series of cross-sectional images of selected Pt modified γ-Ni+γ'-$Ni_3Al$ alloys after 1000 h isothermal oxidation at 1150° C. in air. All images are the same magnification (×500). The compositions are nominal and in atom percent.
Figure 8B:
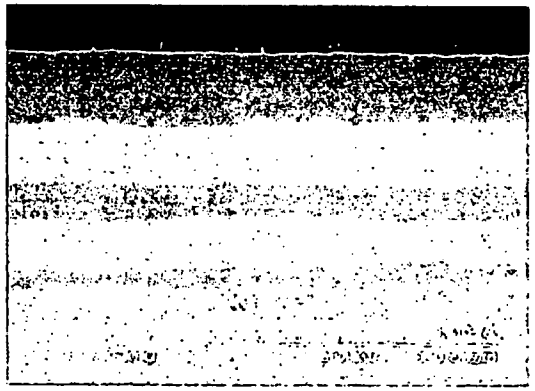
Figure 8C:
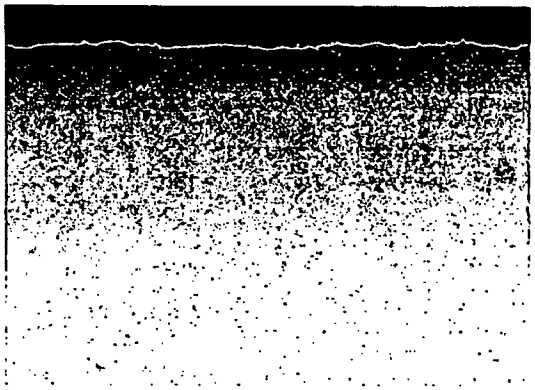

As shown in FIG. 8, a much more planar alloy/scale interface develops if the Ni-22Al-30Pt alloy is modified with 0.5 at. % (1 wt. %) hafnium, such that the alloy composition is Ni-22Al-30Pt-0.5Hf, or if the platinum content in the alloy is reduced. In addition, the alloys having a much more planar alloy/scale interface showed no evidence of forming an intermediate layer of γ+α for the times studied (i.e. up to 1000 hours). A comparison of the images in FIG. 8 shows that further benefit of Hf addition is to significantly decrease the thickness of the $Al_2O_3$ scale that develops on the γ+γ' alloys during oxidation.

Example 2B

Figure 9:
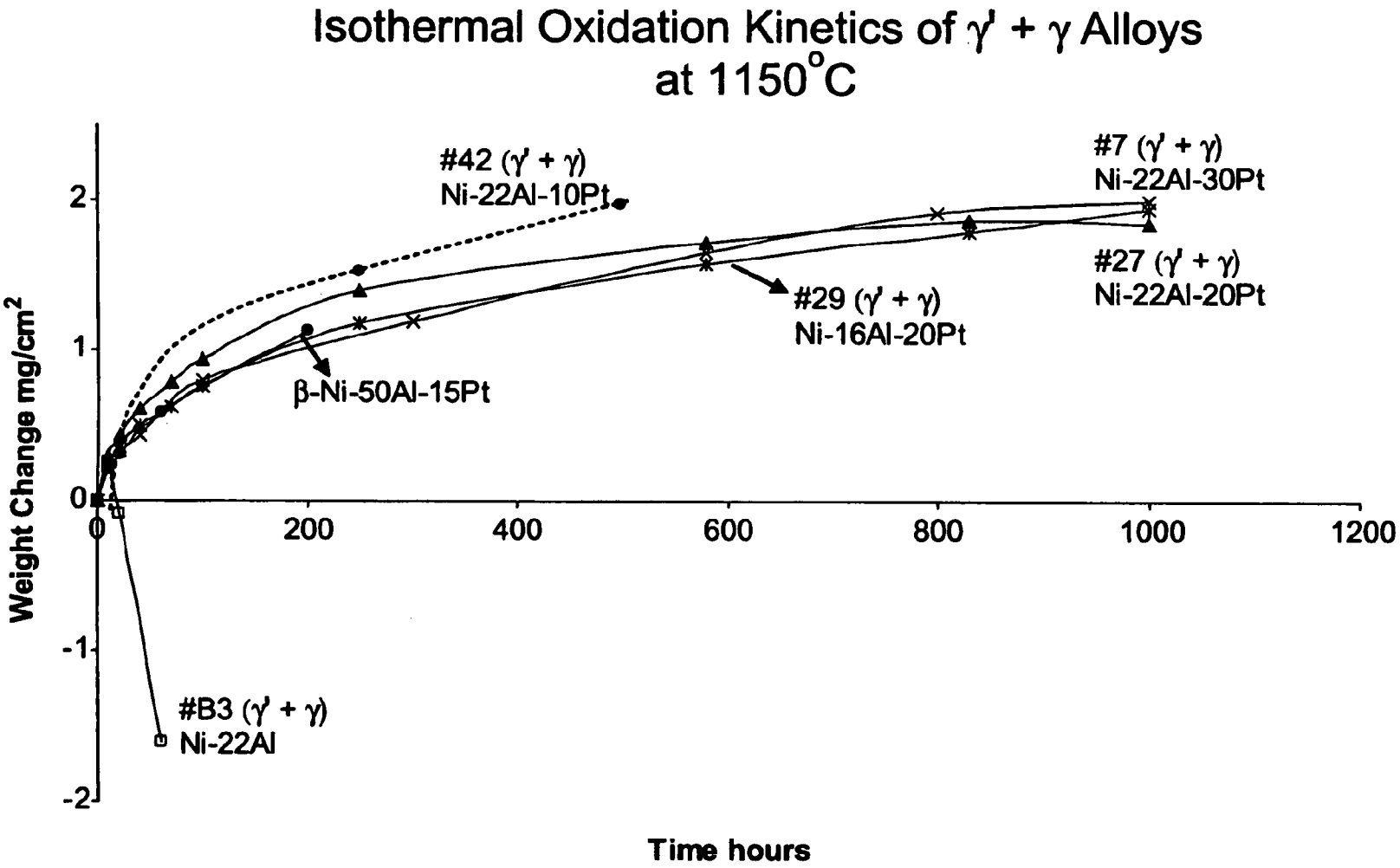
FIG. 9 is a plot showing the cyclic oxidation kinetics at 1150° C. in air of various Pt modified γ-Ni +γ'-$Ni_3Al$ alloys, γ-Ni+γ'-$Ni_3Al$ alloys without Pt, and Pt-modified β-NiAl alloys.
Figure 10A:
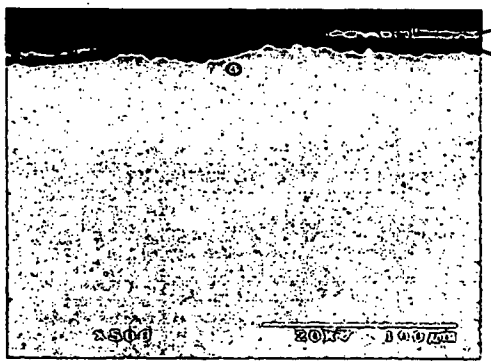
FIG. 10A–D is a series of cross-sectional images of selected Pt modified, and Pt and Hf modified, γ-Ni+γ'-$Ni_3Al$ alloys, and γ-Ni+γ'-$Ni_3Al$ alloys without Pt following isothermal oxidation at 1150° C. in air.
Figure 10C:
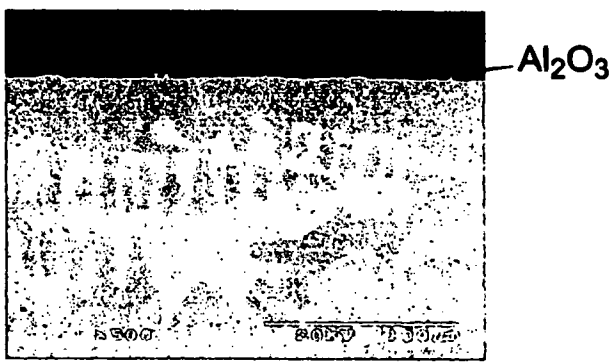
Figure 10B:
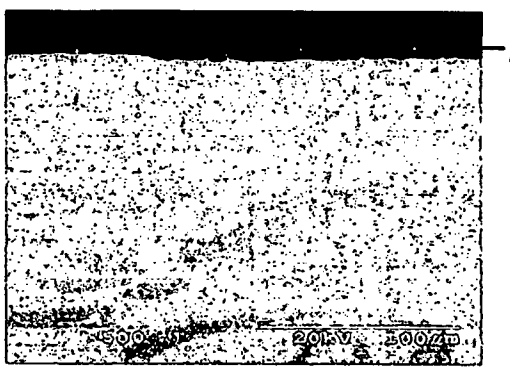
Figure 10D:
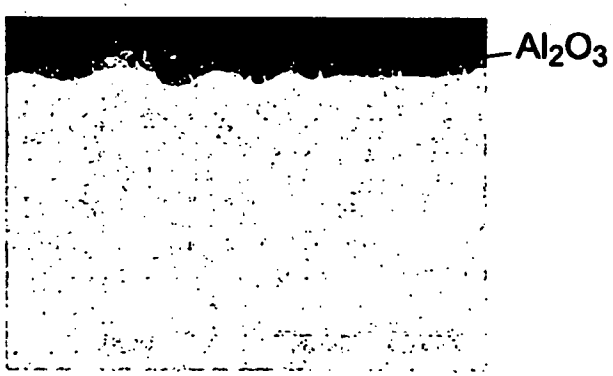

Alloy samples from Example 1 were isothermally and cyclically oxidized at 1150° C. The plot in FIG. 9 shows that a Pt-free γ+γ' alloy (#B3: Ni-22 at. % Al) has very poor cyclic oxidation resistance; whereas, adding 10–30 at. % Pt to this alloy (i.e., keeping the Al content constant at 22 at. % and thus having γ' as the principal phase) significantly improves cyclic oxidation resistance. In the case of alloy #29, it is further shown that the cyclic oxidation resistance is still very good even if the Al content is lowered from 22 to 16 at. % and the Pt content is kept at 20 at. % (i.e. γ is the principal phase).

FIG. 10 shows cross-sectional images of the isothermally oxidized alloys of Example 1. The addition of 10–30 at % Pt to a Ni-22 at % Al promotes the exclusive formation of a continuous and adherent $Al_2O_3$ scale. As indicated, the binary Ni-22 at. % Al alloy B3 forms a poorly adherent scale that contains an out layer of the spinal phase $NiO.Al_2O_3$.

Example 2C

Figure 11:
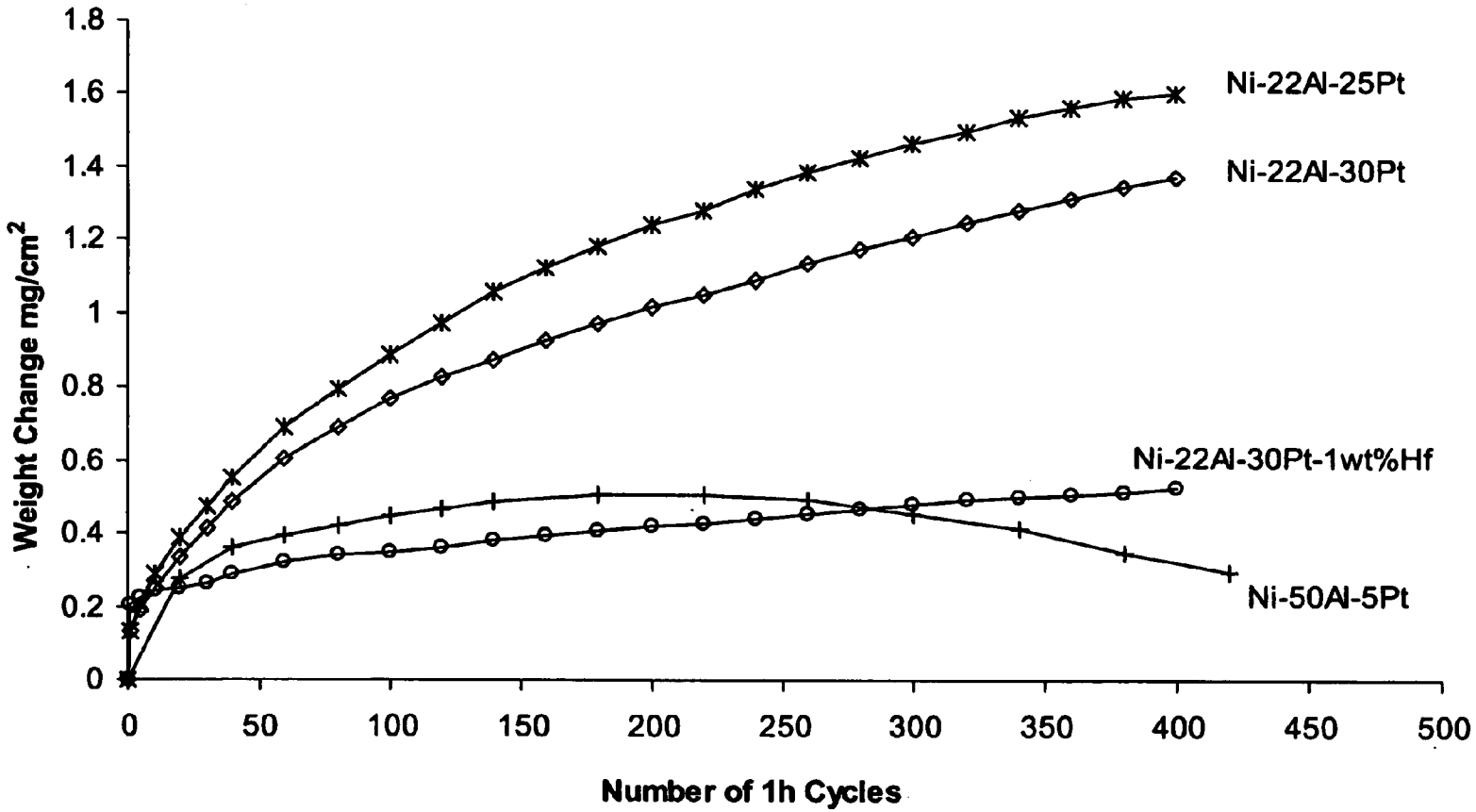
FIG. 11 is a plot comparing the cyclic oxidation kinetics of Pt-modified β-NiAl, γNi+γ'-$Ni_3Al$, and Hf-modified γ-Ni+γ'-$Ni_3Al$ at 1150° C. in air.

FIG. 11 compares the 1150° C. cyclic oxidation kinetics of bulk alloys of the following Pt-modified alloys: β-NiAl (50 at. % Al), γ-Ni+γ'-$Ni_3Al$+(22 at. % Al), and Hf-modified γ-Ni+γ'-$Ni_3Al$+(22 at. % Al). Each thermal cycle consisted of one hour at 1150° C. in air followed by 15 minutes in air at about 120° C. It is seen that the β alloy (based on the commonly used bond coat composition) underwent weight loss, which is indicative of oxide-scale spallation, while the better performing γ+γ' alloys did not show notable evidence of scale spallation. The performance of the Hf-modified alloy is particularly superior, showing minimal weight gain and, therefore, an exceptionally slow rate of oxide-scale growth. It is noteworthy that the beneficial effect of hafnium was observed even at an alloying content of 2 wt. %. Such a high hafnium content would be highly detrimental to the oxidation resistance of a β-based coating, which requires no greater than about 0.1 wt. % hafnium for a beneficial effect. From a practical standpoint, staying below this low maximum is very difficult to achieve and therefore hafnium is generally not intentionally added to b-based coatings. The γ+γ' bond coating compositions being proposed in this application will easily allow for the addition of hafnium and thus for optimization for protective scale formation.

Example 2D

Figure 12:
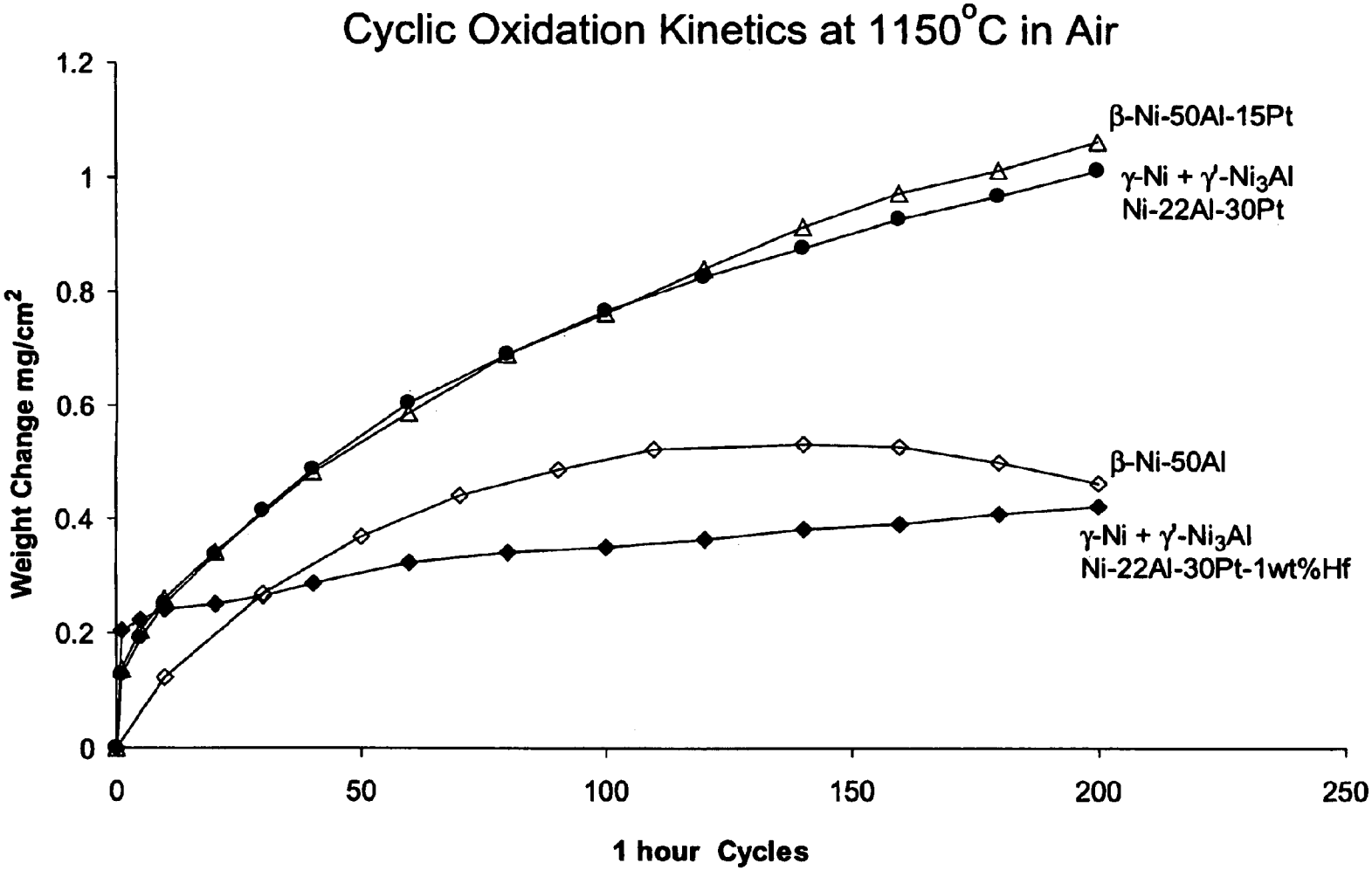
FIG. 12 is a plot comparing the cyclic oxidation kinetics of Pt-modified β-NiAl, γNi+γ'-$Ni_3Al$ alloys and those a Pt-modified β-NiAl alloy at 1150° C. in air.

This example compares the cyclic oxidation kinetics at 1150° C. in air of various alloy compositions. The plot in FIG. 12 shows that the cyclic oxidation kinetics of the Pt-modified γ-Ni+γ'$Ni_3Al$ alloy are comparable to the Pt-modified β-NiAl alloy. The β-NiAl alloy contains 50 at. % Al (i.e., more than double that of the Pt-modified γ-Ni+γ'$Ni_3Al$ alloy) and is representative of alloys used as conventional Pt-modified β-NiAl bond coatings. The plot of FIG. 12 also shows the significant benefit of adding 1 wt. % (~0.5 at. %) Hf to the Pt-modified γ-Ni+γ'$Ni_3Al$ alloy. The rate of $Al_2O_3$ scale growth deceases by almost an order of magnitude with Hf addition.

Example 2E

Figure 13:
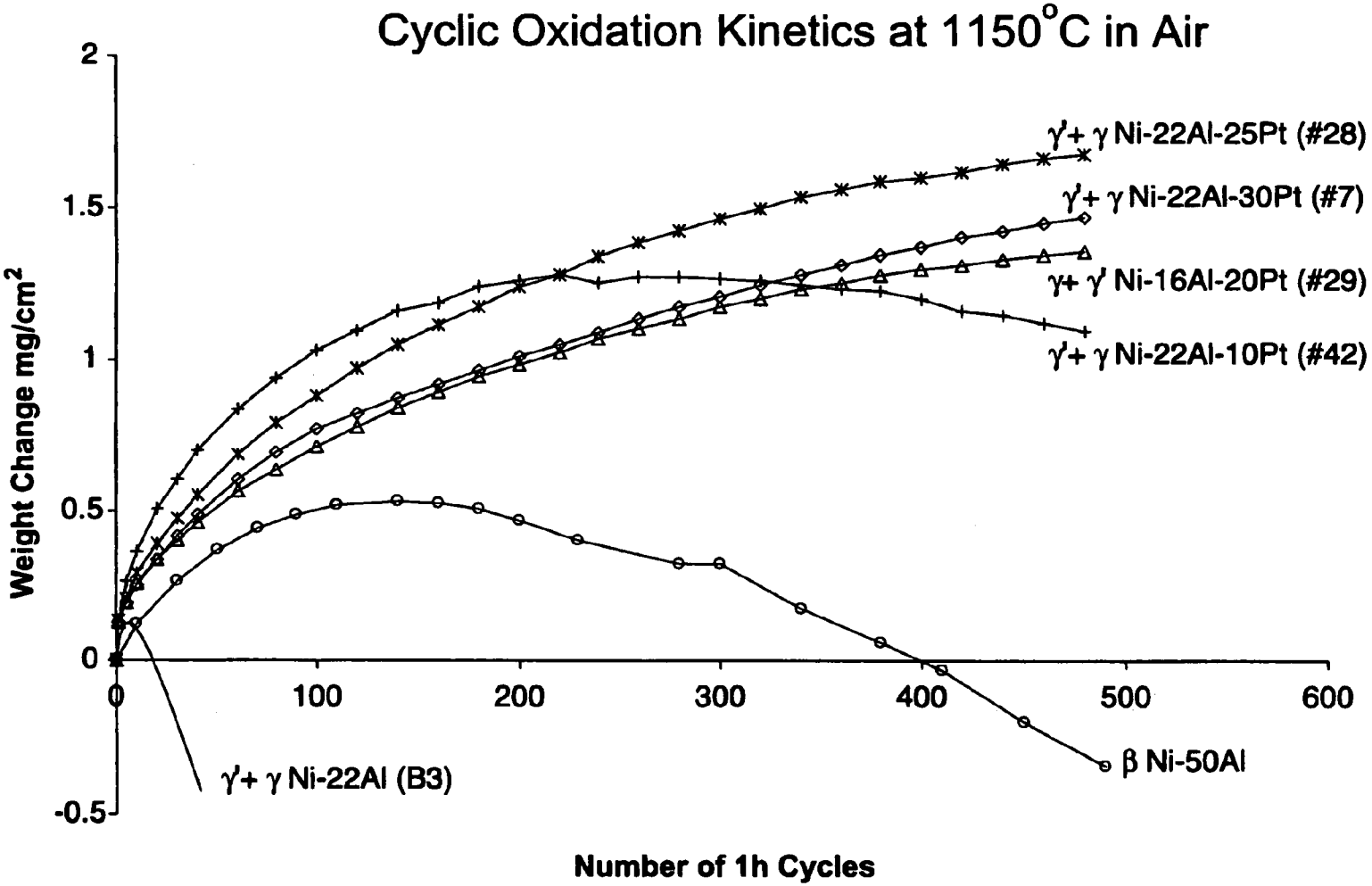
FIG. 13 is a plot comparing the cyclic oxidation kinetics of Pt-modified β-NiAl, γNi+γ'-$Ni_3Al$ alloys of Example 1 and those a Pt-modified β-NiAl alloy at 1150° C. in air.

This example compares the cyclic oxidation kinetics at 1150° C. in air of various γ+γ' alloy compositions of Example 1. The plot in FIG. 13 shows the cyclic oxidation of various Pt-modified γ-Ni+γ'$Ni_3Al$ alloy from Example 1, together with a binary γ-Ni+γ'$Ni_3Al$ alloy (B3 of Example 1, with 22 at. % Al) and a stoichiometric β-NiAl alloy. It is seen that the alloys containing more than 10 at. % Pt exhibit very protective oxidation behavior, with always a positive rate of weight change and, hence, no measurable scale spallation.

Example 2F

Figure 14:
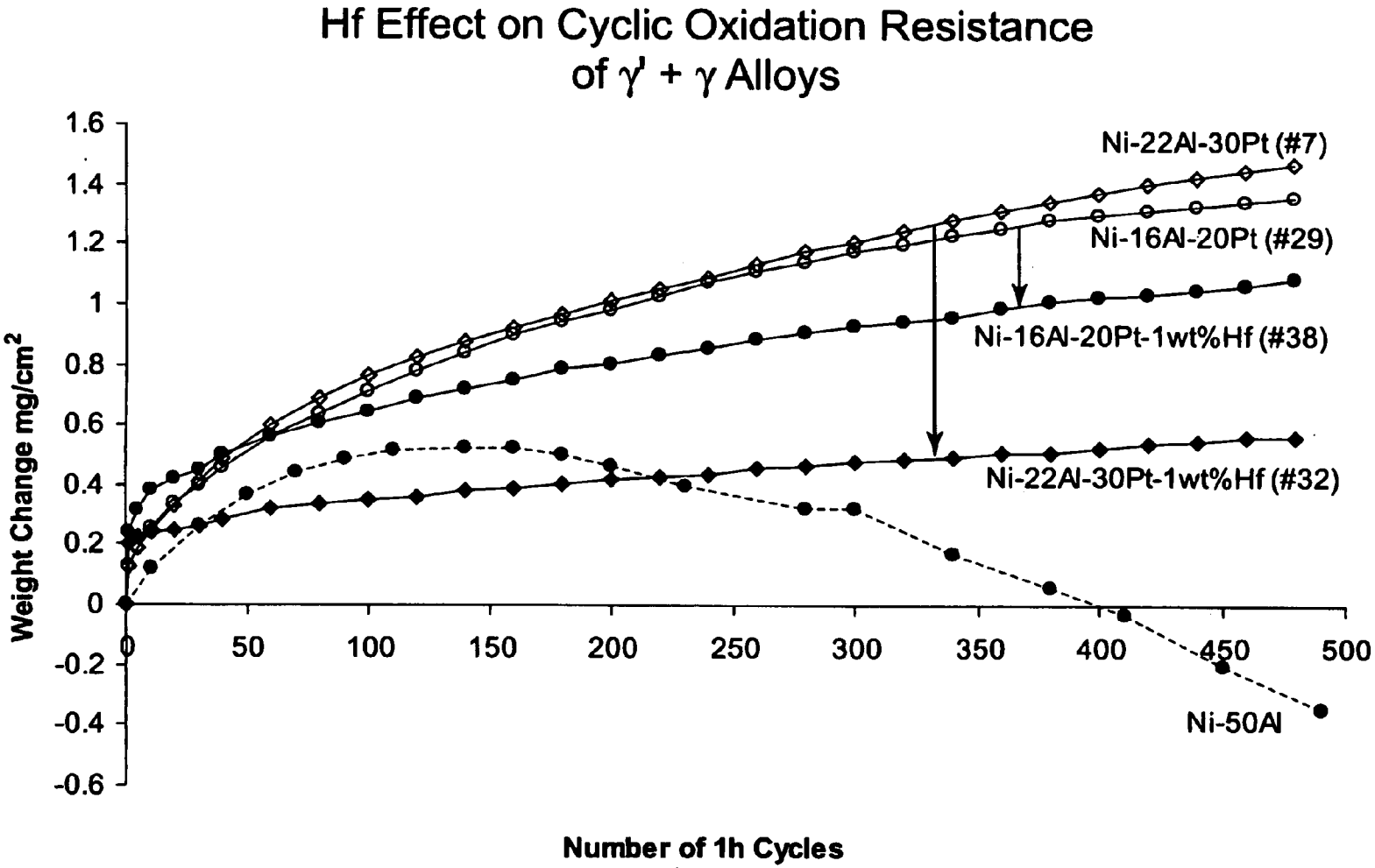
FIG. 14 is a plot showing the effect of Hf modification on the cyclic oxidation kinetics of Pt-modified β-NiAl, γNi+γ'-$Ni_3Al$ alloys of Example 1.
Figure 15A:
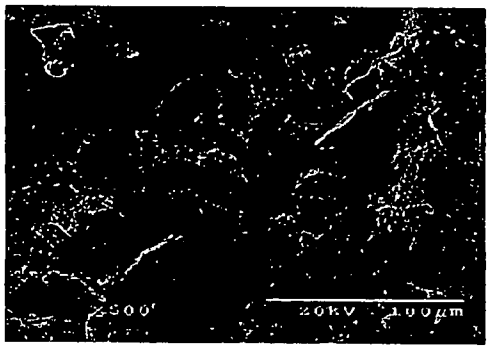
FIG. 15A,C and FIG. 15B,D are surface and cross-sectional images, respectively, illustrating the effect of Hf modification on selected Pt-modified β-NiAl, γNi+γ'-$Ni_3Al$ alloys of Example 1 and FIG. 14.
Figure 15C:
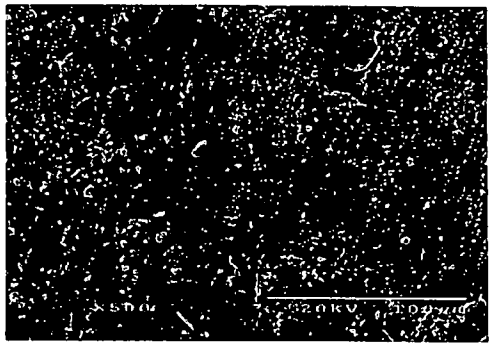
Figure 15B:
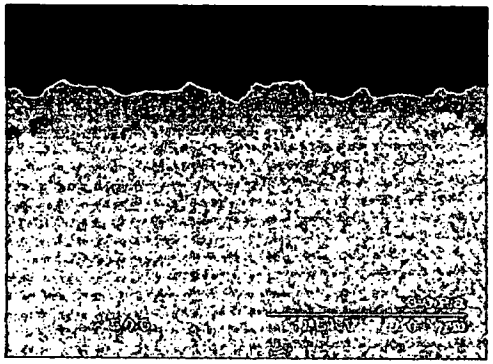
Figure 15D:
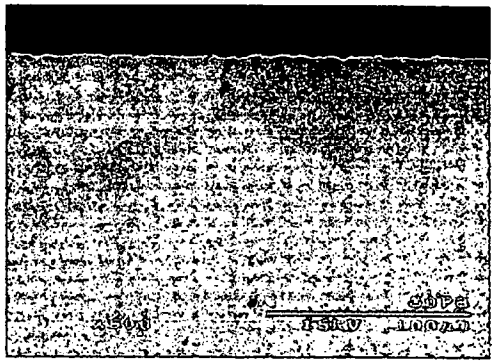

The plot of FIG. 14 shows the beneficial effect of Hf addition for improving the oxidation resistance of various Pt-modified γ-Ni+γ'$Ni_3Al$ alloys from Example 1, together with a stoichiometric β-NiAl alloy. Closer inspection shows that the beneficial effect is greatest when γ' is the principal phase in the alloy (alloy 32, which is alloy 7 with 1 wt % Hf), compared to when γ is the principal phase in the alloy (alloy 38, which is alloy 29 with 1 wt % Hf). This is likely because Hf is much more soluble in γ' than in γ, thus the hafnium is more uniformly distributed in the γ'-based alloy.

As shown in the surface and cross-sectional images of FIG. 15, scale adhesion is much improved with the addition of 1 wt. % (~0.5 at. %) Hf to the Ni-22 at. % Al-30 at. % Pt alloy. A test including 1000 thermal cycles, with each cycle consisting of 1 h at 1150° C.+15 min at ~120° C., is considered a long-term test.

Example 2G

Figure 16:
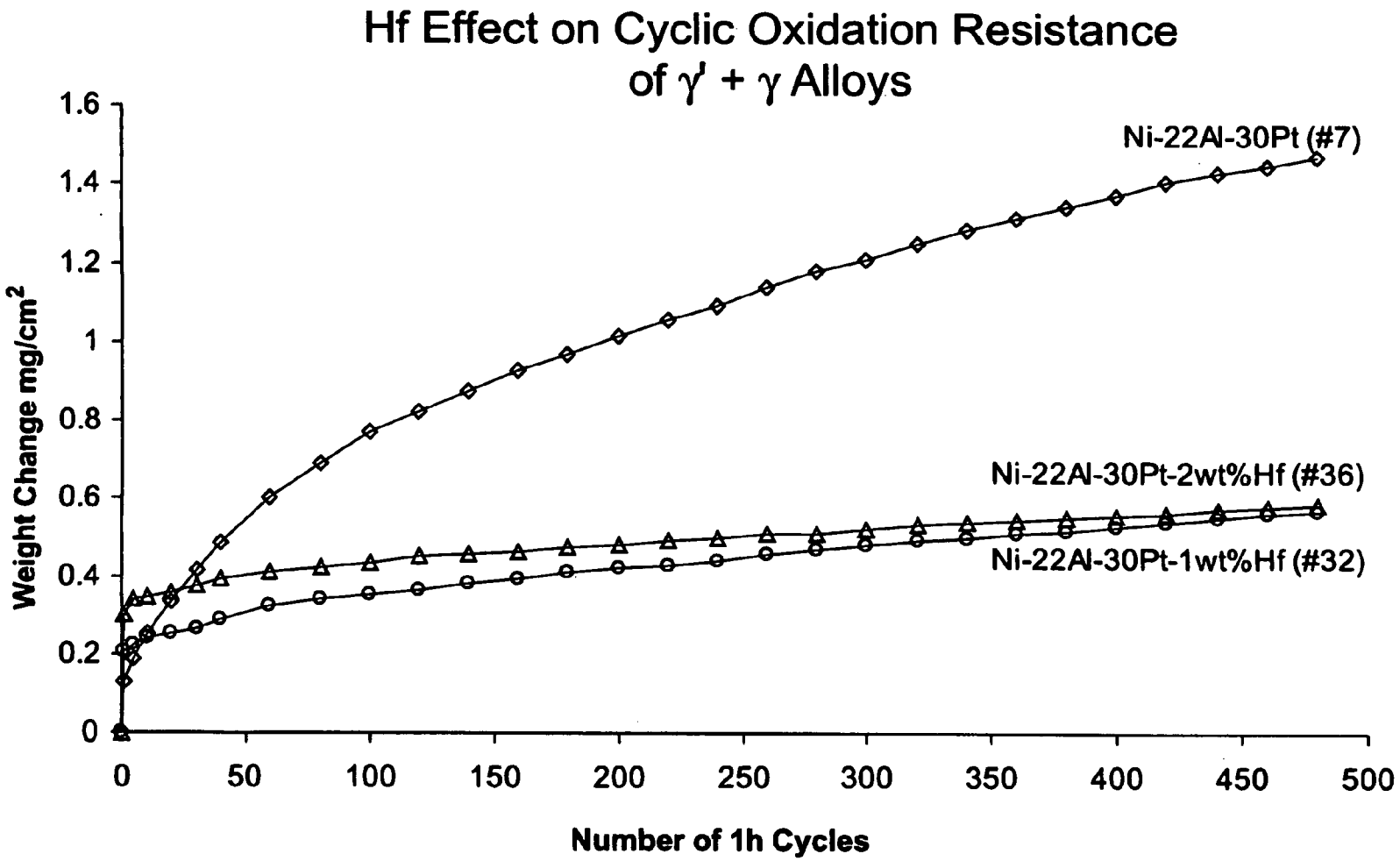
FIG. 16 is a plot showing the effect of Hf modification on the cyclic oxidation kinetics of Pt-modified β-NiAl, γNi+γ'-$Ni_3Al$ alloys of Example 1.

The plot of FIG. 16 shows that the cyclic oxidation resistance of the Pt-modified γ-Ni+γ'$Ni_3Al$ alloy from Example 1 (where γ' is the principal phase) can be improved with the addition of even 2 wt. % (~1 at. %) hafnium (alloy 36, which is alloy 7 with 2 at % Hf). In the context of the currently-used β-NiAl—based coatings, such a high hafnium content would never be used, as it would be detrimental to oxidation resistance.

The cross-sectional images in FIG. 17 show that 1 and 2 wt. % Hf addition to the high-Pt alloy #7 causes a significant reduction in the extent of rumpling at the alloy/scale interface. Rumpling is a progressive roughening of the surface and should be avoided to maintain optimum oxidation resistance.

Example 3

Interdiffusion couples were made by hot isostatic pressing alloy coupons at 1150° C. for 1 hour. Subsequent interdiffusion annealing was carried out at either 1100° C. or 1150° C. for up to 50 h in a flowing argon atmosphere. The diffusion couples were quenched in water at the end of a given interdiffusion anneal. The same characterization techniques discussed above were used to analyze the interdiffusion behavior in the Ni—Al—Pt system.

The effects of Pt on the interdiffusion of Al in Pt modified γ-Ni+γ'-$Ni_3Al$ alloys were studied at 1150° C. It was found that, with sufficient Pt content (e.g., greater than about 15 at. %) the chemical activity of Al in the γ+γ' alloy containing 22 at % Al is decreased to the extent that there is uphill diffusion of Al from the "substrate" (containing ~13–19 at. % Al) to the γ+γ' coating composition.

Figures 18A, 18B, 18C:
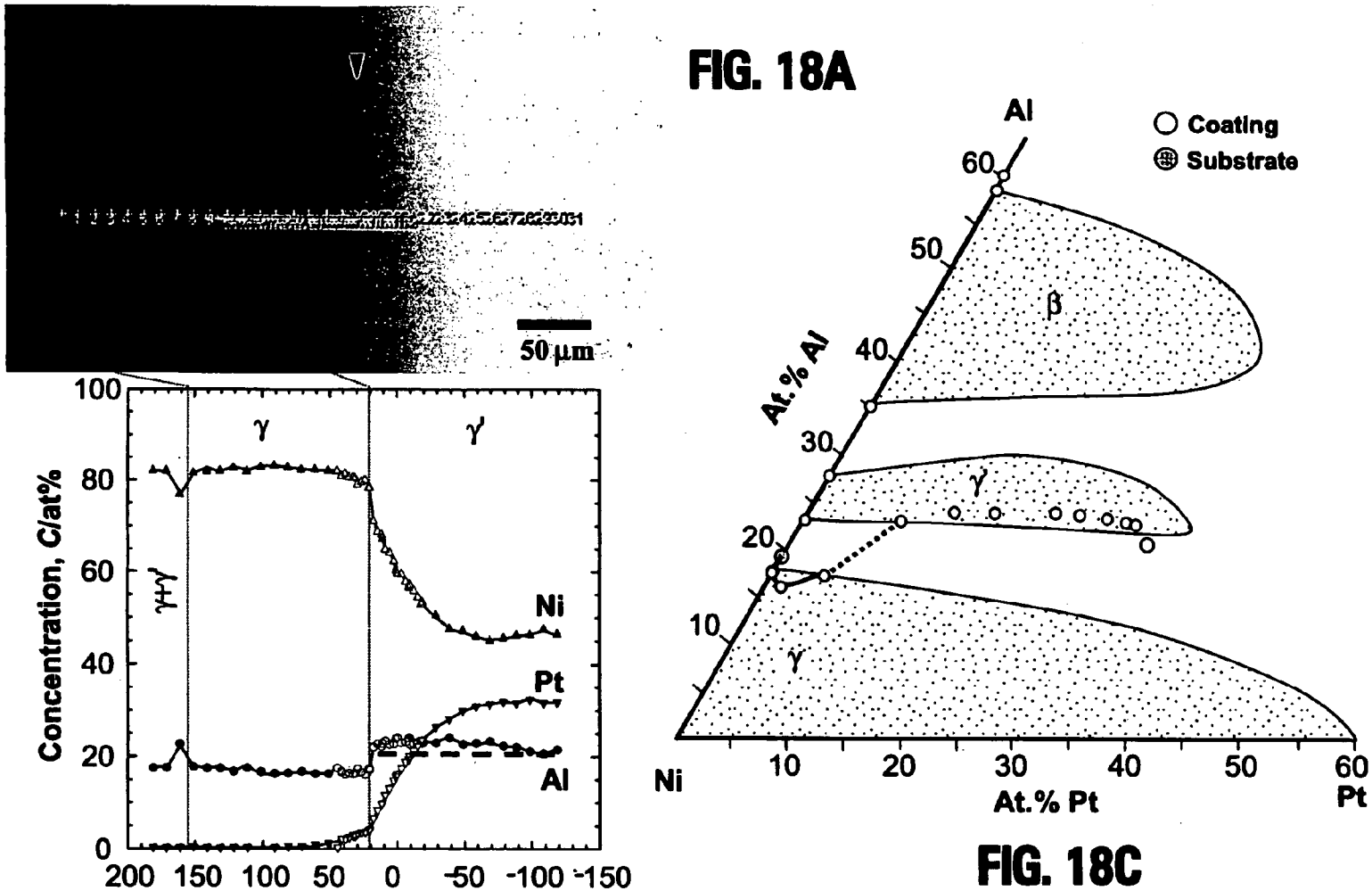
FIG. 18A–C illustrate microstructure and composition profiles through a γ-Ni +γ'-$Ni_3Al$ alloy composition (Ni-22Al-30Pt)/γ-Ni+γ'-$Ni_3Al$ (Ni-22Al) couple after 50 h interdiffusion at 1150° C.

A representative example is shown in FIG. 18 for the case of a γ+γ' (Ni-22Al-30Pt)/γ+γ' (Ni-19Al) couple after 50 h interdiffusion at 1150° C.

Figure 19B:
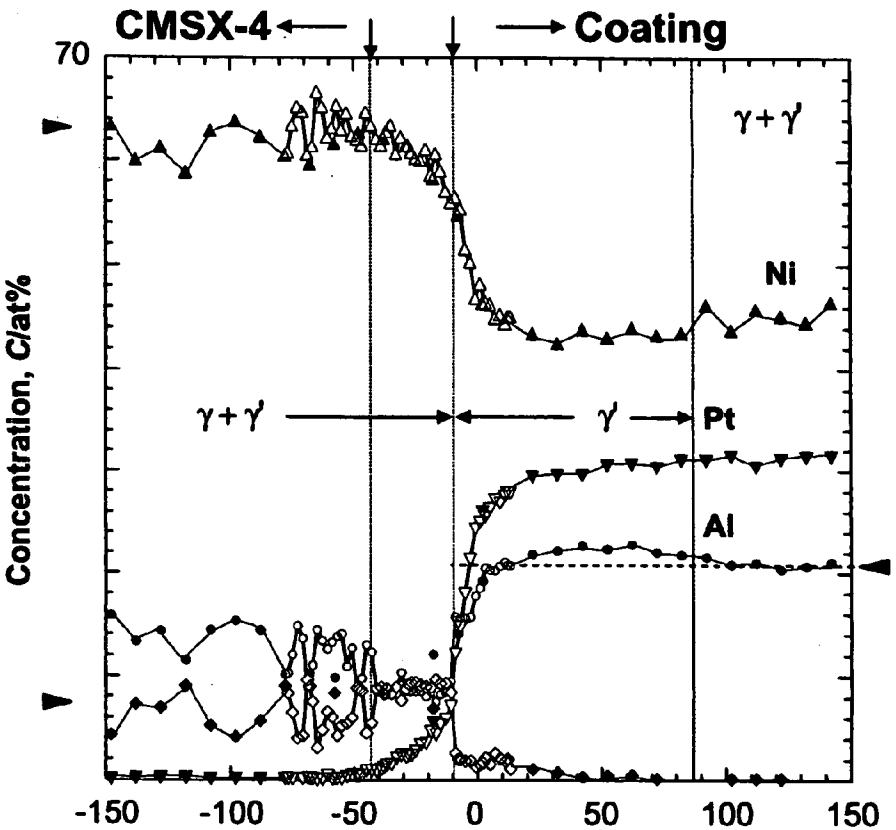
FIG. 19A–B of illustrate microstructure and composition profiles through a γ-Ni +γ'-$Ni_3Al$ alloy composition (Ni-22Al-30Pt)/CMSX-4 couple after 50 h interdiffusion at 1150° C.
Figure 19A:
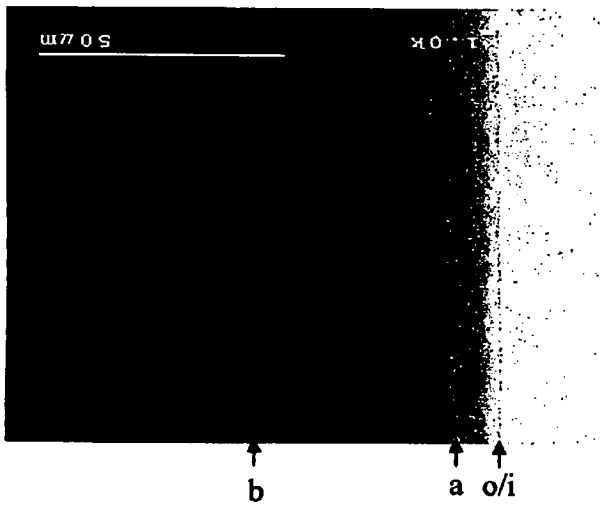

A second representative example is shown in FIG. 19 for the case of a γ+γ' (Ni-22Al-30Pt)/CMSX-4 couple after 50 h interdiffusion at 1150° C.

In each of these examples the enrichment of aluminum in the Al-rich, γ+γ' "coating" side of the couple is clearly evident in the composition profiles shown in FIGS. 18–19. The finding of uphill aluminum diffusion is significant, as it shows that Pt modified γ-Ni+γ'-$Ni_3Al$ alloy coatings can be formulated that will exhibit aluminum replenishment or even enrichment owing to Al diffusion from the substrate to the coating. This latter behavior is in direct contrast to what is observed in β-NiAl containing coatings.

A number of embodiments of the invention have been described. Nevertheless, it will be understood that various modifications may be made without departing from the spirit and scope of the invention. Accordingly, other embodiments are within the scope of the following claims.

What is claimed is:

1. An alloy comprising about 10 at % to about 30 at % of a Pt-group metal, about 10 at % to about 22 at %, about 0.5 at % to about 2 at % of a reactive element selected from the group consisting of Hf, Y, La, Ce and Zr, and combinations thereof, and the remainder Ni, and wherein the alloy has a predominately γ-Ni+γ'-$Ni_3Al$ phase constitution.

2. The alloy of claim 1, wherein the Pt-group metal is selected from the group consisting of Pt, Pd, Ir, Rh and Ru, and combinations thereof.

3. The alloy of claim 1, wherein the N-group metal is Pt.

4. The alloy of claim 1, wherein the reactive clement is Hf.

5. The alloy of claim 4, further comprising a metal selected from the group consisting of Cr, Co, Mo, Ta, and Re, and combinations thereof.

6. The alloy of claim 4, wherein the Hf, is present at a concentration of about 0.5 at % to about 1 at %.

7. The alloy of claim 6, further comprising a metal selected from the group consisting of Cr, Co, Mo, Ta, and Re, and combinations thereof.

8. The alloy of claim 1, further comprising a metal selected from the group consisting of Cr, Go, Mo, Ta, and Re, and combinations thereof.

9. The alloy of claim 1, wherein the phase constitution of the alloy is predominately γ'.

10. A coating on a substrate, wherein the coating comprises about 10 at % to about 30 at % of a Pt-group metal, about 10 at % to about 22 at % Al, about 0.5 at % to about 2 at % of a reactive element selected from the group consisting of Hf, Y, La, Ce, Zr and combinations thereof, and the remainder Ni, and wherein the coating has a predominately γ-Ni +γ'-$Ni_3Al$ phase constitution.

11. The coating of claim 10, wherein the a Pt-group metal is selected from the group consisting of Pt, Pd, Ir, Rh and Ru, and combinations thereof.

12. The coating of claim 11, wherein the Pt-group metal is Pt.

13. The coating of claim 10, wherein the reactive element is Hf.

14. The coating of claim 13, wherein the composition has a γ' phase constitution.

15. The coating of claim 13, wherein the substrate is a metal.

16. The coating of claim 10, further comprising a metal selected from the group consisting of Cr, Co, Mo, Ta, and Re, and combinations thereof.

17. The coating of claim 16, wherein the substrate is a metal.

18. The coating of claim 10, wherein the substrate is a metal.

19. The coating of claim 10, wherein the phase constitution of the coating is predominately γ'.

20. The coating of claim 10, wherein the reactive element is Hf and the phase constitution of the coating is predominately γ'.

21. A thermal barrier coated article comprising:

(a) a superalloy substrate;

(b) a bond coat on the substrate, wherein the bond coat comprises about 10 at % to about 30 at % of a Pt-group metal, about 10 at % to about 22 at % Al about 0.5 at % to about 2 at % of a reactive element selected from the group consisting of Hf, Y, La, Ce, Zr, and combinations thereof, and the remainder Ni, and wherein the bond coat has a predominately γ-Ni+γ'-$Ni_3Al$ phase constitution.

22. The article of claim 21, wherein the Pt-group metal is selected from the group consisting of Pt, Pd, Ir, Rh and Ru, and combinations thereof.

23. The article of claim 22, wherein the Pt-group metal is Pt.

24. The article of claim 23, wherein the bond coat further comprises a metal selected from the group consisting of Cr, Co, Mo, Ta, and Re, and combinations thereof.

25. The article of claim 21, further comprising an adherent layer of oxide on the bond coat.

26. The article of claim 25, further comprising a ceramic coating on the adherent layer of oxide.

27. The article of claim 21, wherein the reactive element is Hf.

28. The article of claim 21, wherein the phase constitution of the bond coat is predominately γ'.

29. A method comprising forming on a substrate by at least one of chemical vapor deposition, physical vapor deposition and sputtering a coating comprising about 10 at % to about 30 at % Pt, about 10 at % to about 22 at % Al, about 0.5 at % to about 2 at % of a reactive element selected from the group consisting of Hf, Y, La, Ce, Zr, and combinations thereof, and the remainder Ni, wherein the coating has a predominately γ-Ni+γ'-$Ni_3Al$ phase structure.

30. The method of claim 29, wherein the reactive element is Hf,

31. The method of claim 29, wherein die coating comprises about 0.5 at % to about 1 at % Hf.

32. The method of claim 29, wherein the coating further comprises a metal selected from the group consisting of Cr, Co, Mo, Ta, and Re, and combinations thereof.

33. The method of claim 29, wherein the substrate is selected from Ni and Co superalloy articles.

34. The method of claim 29, wherein the phase constitution of the coating is predominately γ'.

35. A thermal barrier coated article comprising:

(a) a superalloy substrate;

(b) a bond coat on the substrate, wherein the bond coat comprises a ternary alloy of Pt—Ni—Al, and wherein the alloy comprises about 10 at % to about 30 at % Pt, about 10 at % to about 22 at % Al, about 0.5 at % to about 2 at Hf, and the remainder Ni, and wherein the alloy has a predominately γ-Ni+γ'-$Ni_3Al$ phase constitution;

(c) an adherent layer of oxide on the bond coat; and (d) a ceramic coating on the adherent layer of oxide.

36. The article of claim 35, wherein the bond coat comprises about 0.5 at % to about 1 at % Hf.

37. The coating of claim 35, wherein the bond coat has a thickness of about 5 μm to about 100 μm.

38. The coating of claim 35, wherein the bond coat has a thickness of about 10 μm to about 50 μm.

39. The article of claim 35, wherein the phase constitution of the bond coat is predominately γ'.

40. A Ni—Al—Pt—Hf alloy comprising less than about 23 at % Al, about 10 at % to about 30 at % of a Pt-group metal, about 0.5 at % to about 2 at % Hf, and the remainder Ni, wherein the alloy has a predominately γ-Ni+γ'-$Ni_3Al$ phase constitution.

41. The alloy of claim 40, wherein the Pt-group metal is Pt.

42. The alloy of claim 41, wherein the Hf is present in the alloy at a concentration of about 0.5 at % to about 1 at %.

43. The alloy of claim 40 comprising about 10 at % to about 22 at % Al and about 15 at % to about 30 at % of the Pt-group metal.

44. An alloy comprising about 10 at % to about 22 at % Al, about 15 at % to about 30 at % Pt, about 0.5 at % to about 2 at % Hf and the remainder Ni, wherein the alloy has a predominately γ-Ni+γ'-$Ni_3Al$ phase constitution.

45. A coating composition comprising about 10 at % to about 22 at % Al, about 10 at % to about 30 at % Pt, about 0.5 at % to about 2 at % Hf, and the remainder Ni, wherein the alloy has a predominately γ-Ni+γ'-$Ni_3Al$ phase constitution.

46. The coating composition alley of claim 45, wherein Pt is present at about 15 at % to about 30 at %, and Hf is present at about 0.5 at % to about 1 at%.

47. A thermal baffler coated article comprising a superalloy substrate and a bond coat on the substrate, wherein the bond coat comprises an alloy comprising about 10 at % to about 22 at % Al, about 15 at % to about 30 at % Pt, about 0.5 at % to about 2 at % Hf, and the remainder Ni, wherein the alloy has a predominately γ-Ni+γ'-$Ni_3Al$ phase constitution.

48. The barrier coated article of claim 47, wherein the alloy comprises, about 15 at % to about 30 at % Pt, and-about 0.5 at % to about 1 at % Hf.

* * * * *

UNITED STATES PATENT AND TRADEMARK OFFICE

CERTIFICATE OF CORRECTION

PATENT NO. : 7,273,662 B2
APPLICATION NO. : 10/439649
DATED : September 25, 2007
INVENTOR(S) : Gleeson et al.

It is certified that error appears in the above-identified patent and that said Letters Patent is hereby corrected as shown below:

On Column 2, Line 47, "γ-NiAl" should read --β-NiAl--

On Column 3, Line 6, "γ' refers" should read --γ refers--

On Column 3, Line 56, "γ-Ni + 7'-$Ni_3Al$" should read --γ-Ni + γ'-$Ni_3Al$--

On Column 4, Line 62, "β-NiAl", should read --β-NiAl,--

On Column 5, Line 1, delete the word "of"

On Column 12, Line 4, "N-group" should read --Pt-group--

On Column 13, Line 19, "die" should read --the--

On Column 14, Line 27, delete the word "alley"

On Column 14, Line 30, "baffler" should read --barrier--

Signed and Sealed this

First Day of July, 2008

JON W. DUDAS
*Director of the United States Patent and Trademark Office*